US005113744A

United States Patent [19]

Tanaka et al.

[11] Patent Number: 5,113,744

[45] Date of Patent: May 19, 1992

[54] AUTOMATIC PERFORMANCE APPARATUS HAVING PLURAL MEMORY AREAS

[75] Inventors: So Tanaka; Takashi Hirakata; Shingo Kawasaki; Takuya Nakata; Hitoshi Makita; Koichi Kozuki, all of Hamamatsu, Japan

[73] Assignee: Yamaha Corporation, Hamamatsu, Japan

[21] Appl. No.: 776,675

[22] Filed: Oct. 10, 1991

Related U.S. Application Data

[63] Continuation of Ser. No. 370,775, Jun. 23, 1989, abandoned, which is a continuation-in-part of Ser. No. 298,562, Jan. 17, 1989, abandoned.

[30] Foreign Application Priority Data

| | | | |
|---|---|---|---|
| Jan. 14, 1988 | [JP] | Japan | 63-6416 |
| Feb. 10, 1988 | [JP] | Japan | 63-29111 |
| Feb. 10, 1988 | [JP] | Japan | 63-29112 |
| Jun. 23, 1988 | [JP] | Japan | 63-155628 |
| Jun. 23, 1988 | [JP] | Japan | 63-155629 |

[51] Int. Cl.[5] ..... G10H 1/36; G10H 1/40/7/00

[52] U.S. Cl. ..... 84/634; 84/635; 84/DIG. 12

[58] Field of Search ..... 84/609-614, 84/634-638, DIG. 12, DIG. 22, DIG. 29

[56] References Cited

U.S. PATENT DOCUMENTS

| | | | |
|---|---|---|---|
| 4,602,546 | 7/1986 | Shinohara | 84/609 |
| 4,624,171 | 11/1986 | Yuzawa et al. | 84/611 X |
| 4,742,748 | 5/1988 | Tateishi | 84/611 |

FOREIGN PATENT DOCUMENTS

| | | |
|---|---|---|
| 53-70421 | 6/1978 | Japan . |
| 58-2890 | 1/1983 | Japan . |
| 58-211191 | 12/1983 | Japan . |
| 62-187387 | 8/1987 | Japan . |

*Primary Examiner*—Stanley J. Witkowski
*Attorney, Agent, or Firm*—Spensley Horn Jubas & Lubitz

[57] ABSTRACT

An automatic performance apparatus provides a performance data memory including plural storing areas each capable of storing different performance data independently. The performance data can be selectively written in and read from each storing area. Based on the performance data read from each storing area, a musical tone signal for an automatic performance is generated independently. When the performance data memory includes two storing areas, the performance data concerning two tunes or two parts can be stored. One of two automatic performances based on the performance data can be selectively played. In addition, two automatic performances can be also player simultaneouly, wherein a predetermined delay time can be provided between two automatic performances. Further, predetermined kinds of rhythm patterns are pre-stored in a rhythm pattern memory in order to perform the desirable rhythm pattern as an accompaniment of the automatic performance.

8 Claims, 27 Drawing Sheets

( PERFORMANCE DATA MEMORY 62)

(DATA FORMAT)

(MAIN ROUTINE)

AUTOMATIC PERFORMANCE APPARATUS HAVING PLURAL MEMORY AREAS

This is a continuation of application Ser. No. 07/370,775 filed on Jun. 23, 1989, now abandoned, which is a continuation-in-part of application Ser. No. 07/298,562 filed on Jan. 17, 1989, now abandoned.

BACKGROUND OF THE INVENTION

1. Field of the Invention

The present invention relates to an automatic performance apparatus, and more particularly to an automatic performance apparatus by which an automatic performance is played based on a plurality of performance data stored in plural storing areas.

2. Prior Art

The first conventional automatic performance apparatus sequentially writes the performance data in one memory (such as a semiconductor memory, a magnetic tape etc.) and then plays the automatic performance based on the read performance data. However, in the recently developed automatic performance apparatus, a storing area of memory is divided into plural storing areas in advance, wherein each storing area can write and read the independent performance data.

In such automatic performance apparatus, there is a possibility in that the same performance data will be written into the plural storing areas.

The second conventional automatic performance apparatus (as disclosed in Japanese Patent Laid-Open Publication No. 58-211191) provides a record mode for recording the performance data into the memory and an automatic performance mode for generating a musical tone by reading the performance data from the memory. By operating a select switch, any one of the off mode, record mode and automatic performance mode can be selected.

However, such second conventional apparatus can select the automatic performance mode even when the performance data are not stored in the memory at all. Hence, in some cases, the automatic performance can not be played by depressing a performance start button, so that the user will judge that any trouble is occurred by mistake.

The third conventional apparatus (as disclosed in Japanese Patent Laid-Open Publication No. 53-70421) changes a rhythm pattern to its final pattern by which the automatic performance will be ended by operating a control switch (i.e., stop switch).

However, it is preferable to end the automatic performance at a first bar end timing after the stop switch is operated instead of ending the automatic performance immediately after the stop switch is operated. In this case, it is also preferable to re-start the automatic performance with ease after the automatic performance is ended.

The fourth conventional apparatus starts to play the automatic performance based on the performance data which are simultaneously read from each storing areas of memory.

In such fourth conventional apparatus, the musical tone of the harpsichord is generated based on the performance data stored in a first storing area, while another musical tone of the horn is generated based on the performance data stored in a second storing area. Normally, the rising of musical tone of the harpsichord is faster than that of the horn. Hence, when these two musical tones of the harpsichord and the horn are simultaneously reproduced, these two musical tones can be heard such that the musical tone of the horn will be delayed as compared to that of the harpsichord. This makes the listener nervous.

Lastly, the fifth conventional apparatus (as disclosed in Japanese Patent Laid-Open Publication No. 62-187387) stores the performance data in addition to designation information for designating an accompaniment kind (such as kinds of rhythm tones, bass tones etc.), whereby this apparatus can generate the musical tone based on the performance data and the accompaniment tone based on the designation information to thereby play a duet performance in the automatic performance.

However, in such fifth conventional apparatus, there is a possibility in that plural kinds of accompaniments must be played in correspondence with the performance data so that the duet performance can not be played.

SUMMARY OF THE INVENTION

It is accordingly a primary object of the present invention to provide an automatic performance apparatus capable of playing the automatic performance according to needs of the user.

It is another object of the present invention to provide an automatic performance apparatus capable of arbitrarily generating melody musical tone with the accompaniment musical tone to thereby play the duet automatic performance.

In a first aspect of the invention, there is provided an automatic performance apparatus comprising:

(a) memory means having a plurality of storing areas each capable of storing performance data;
(b) writing means for writing the performance data into the storing areas;
(c) reading means for reading the performance data from the storing areas;
(d) musical tone signal generating means for generating a musical tone signal based on the performance data read from the memory means;
(e) selecting means which is provided for each storing area capable of selecting at least one of off mode, record mode and automatic performance mode;
(f) detecting means for detecting whether any one of the storing areas is in the record mode or not; and
(g) control means for prohibiting other storing areas from being set to the record mode when the detecting means detects that one storing area is in the record mode.

In a second aspect of the invention, there is provided an automatic performance apparatus comprising:

(a) a memory for storing performance data;
(b) writing means for writing the performance data into the memory;
(c) reading means for reading the performance data from the memory;
(d) musical tone signal generating means for generating a musical tone signal based on the performance data read from the memory means;
(e) selecting means for selecting one of off mode, record mode and automatic performance mode;
(f) detecting means for detecting whether the performance data are stored in the memory or not; and
(g) control means for prohibiting the automatic performance mode from being selected by the selecting means when the detecting means detects that the performance data are not stored in the memory.

In a third aspect of the invention, there is provided an automatic performance apparatus comprising:

(a) a memory for storing performance data;

(b) reading means for reading the performance data from the memory;

(c) means for generating a musical tone signal corresponding to an automatic performance based on the performance data read from the memory;

(d) a switch; and (e) control means for controlling the means to stop the automatic performance at a start timing of bar next to a preceding bar when the switch is operated while the automatic performance is played, the control means further controlling the means to re-start the automatic performance at the start timing when the switch is operated while the automatic performance is stopped.

In a fourth aspect of the invention, there is provided an automatic performance apparatus comprising:

(a) a memory for storing performance data;

(b) writing means for writing the performance data into the memory;

(c) reading means for reading the performance data from the memory;

(d) means for generating a musical tone signal corresponding to an automatic performance based on the performance data read from the memory;

(e) a switch; and (f) control means for controlling the writing means to stop its writing operation of the performance data at a start timing of bar next to a preceding bar when the switch is operated while the performance data are written into the memory.

In a fifth aspect of the invention, there is provided an automatic performance apparatus comprising:

(a) a plurality of memories each storing performance data;

(b) reading means for reading the performance data from the memory;

(c) musical tone signal generating means for generating a musical tone signal based on the performance data read from the memory; and (d) delay means for delaying a timing of generating the musical tone signal based on the performance data stored in one memory behind other timings of generating the musical tone signals based on the performance data stored in other memories by a predetermined delay time.

In a sixth aspect of the invention, there is provided an automatic performance apparatus comprising:

(a) a performance data memory having a plurality of storing areas each capable of storing performance data;

(b) writing means for writing the performance data into desirable storing areas within the performance data memory;

(c) reading means for reading the performance data from the desirable storing area;

(d) musical tone signal generating means for generating a musical tone signal based on the performance data read from the performance data memory;

(e) an accompaniment data memory having a plurality of storing areas each storing accompaniment data corresponding to several kinds of accompaniments;

(f) means for generating an accompaniment musical tone signal accompanied with the musical tone signal based on the performance data, the accompaniment musical tone signal being generated based on the accompaniment data supplied to the means; and (g) accompaniment data designating means for designating single accompaniment data corresponding to performance data read from one storing area within the performance data memory when musical tone signal is to be generated based on the performance data, the accompaniment data designating means designating any one of plural accompaniment data corresponding to plural performance data read from plural storing areas within the performance data memory when plural musical tones are to be generated based on the plural performance data.

In a seventh aspect of the present invention, there is provided an automatic performance apparatus comprising:

(a) a memory including plural, areas each capable of storing different performance data independently;

(b) selecting means for selecting at least any one of the areas whose performance data is to be read out; and (c) automatic performance means for playing an automatic performance based on the performance data which is read from a selected area.

In an eighth aspect of the present invention, there is provided an automatic performance apparatus comprising:

(a) a memory including two areas each capable of storing performance data independently;

(b) delay means for providing a delay time between a reading timing of the performance data from one area and another reading timing of the performance data from another area; and (c) automatic performance means for playing two kinds of automatic performances based on the performance data read from the two areas with the delay time.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 16 shows data formats of performance data used in the second embodiment;

DESCRIPTION OF PREFERRED EMBODIMENTS

Next, description will be given with respect preferred embodiments of the present invention in conjunction with several drawings.

[I] FIRST EMBODIMENT (A) Configuration of First Embodiment

Figure 1:
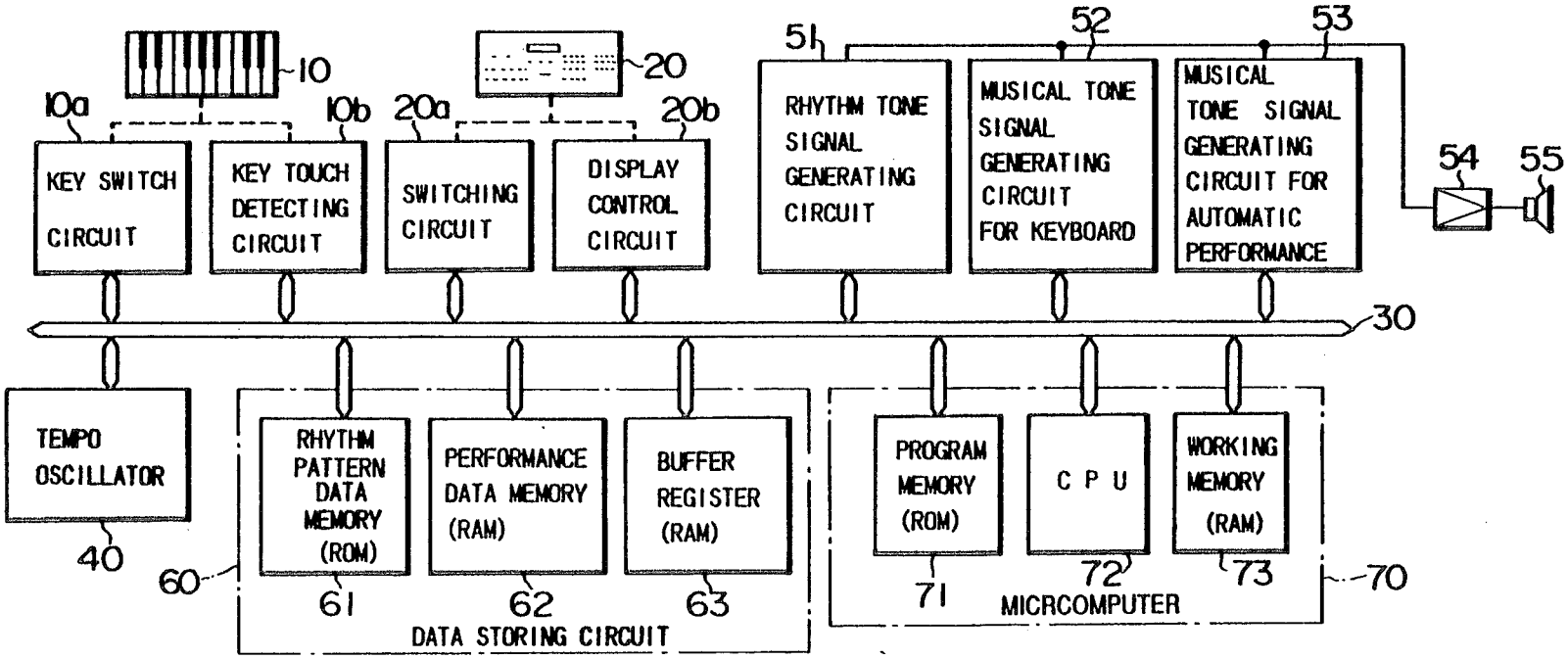
FIG. 1 is a block diagram showing a configuration of an electronic musical instrument employing an automatic performance apparatus according to a first embodiment of the present invention.

FIG. 1 is a block diagram showing the configuration of the electronic musical instrument employing the automatic performance apparatus according to the first embodiment of the present invention.

This electronic musical instrument shown in FIG. 1 provides a keyboard 10 and a console panel 20. The keyboard 10 includes by plural keys whose corresponding key switches are provided in a key switch circuit 10*a*. Hence, depression and release of each key is detected by on and off states of each key switch. In addition, plural key touch sensors are provided corresponding to the keys in a key-touch detecting circuit 10*b*, wherein each key touch sensor operates in response to the depression and release of each key. Therefore, each of these key touch sensors detects an initial key touch of each key such as key-depressing speed, key-depressing pressure and the like. These key switch circuit 10*a* and key-touch detecting circuit 10*b* are respectively connected to a bus B.

Figure 2:
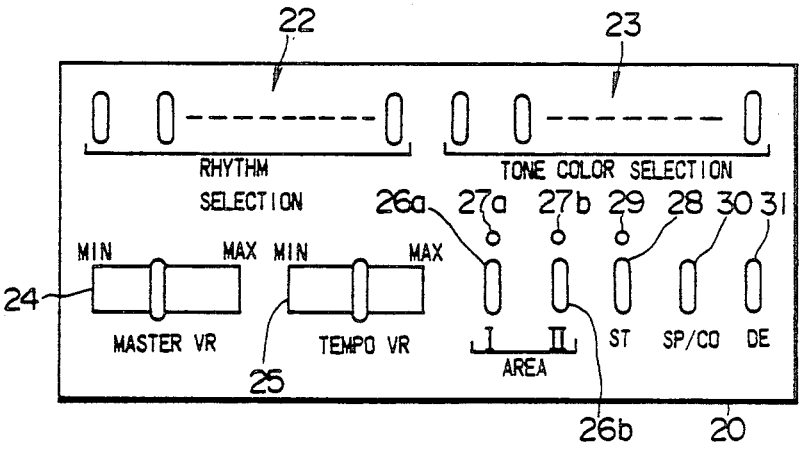
FIG. 2 is a front view showing a console panel 20 shown in FIG. 1.

As shown in FIG. 2, the console panel 20 provides rhythm selecting switches 222 for selecting rhythm kinds such as 8-beat, samba etc.; tone color selecting switch 23 for selecting tone colors such as piano, flute etc.; a master volume 24 for adjusting a tone volume of musical tone to be generated: a tempo volume for adjusting a tempo of musical tone to be generated; track switches 26*a* and 26*b* for designating memory areas; light emitting diodes (LEDs) 27*a* and 27*b* which are respectively arranged at upper positions of track switches 26*a* and 26*b*; a start switch 28 for designating the start of automatic performance or recording start of performance data; another LED 29 which is arranged at an upper position of start switch 28; a stop/continue switch 30 for designating the stop of automatic performance or recording stop of performance data and also designating the re-start of stopped automatic performance; and a delete switch 31 for designating the erasure of performance data within the memory. A switching circuit 20*a* encodes the outputs of these switches in the console panel 20 to the bus B. In addition, a display control circuit 20*b* controls the LEDs 27*a*, 27*b* and 29 to be lighted on or off.

The bus B is connected with a tempo oscillator 40, a rhythm tone signal generating circuit 51, a musical tone signal generating circuit 52 for keyboard, a musical tone signal generating circuit 53 for automatic performance, a data storing circuit 60 and a microcomputer 70. The tempo oscillator 40 outputs a tempo clock to the microcomputer 70 via the bus B in accordance with the set tempo, wherein this tempo clock is used as a rhythm interrupt signal. The rhythm signal generating circuit 51 has plural percussive musical tone signal generating circuits capable of generating percussive musical tone signals corresponding to a cymbal, bass drum and the like. In response to a rhythm pattern data which are supplied from the microcomputer 70 via the bus B, this circuit 51 generates and outputs the percussive musical tone signals. Each of two musical tone signal generating circuits 52 and 53 provides plural channels for generating musical tone signals corresponding to musical instruments such as piano, violin and the like. Herein, the circuit 52 generates the musical tone signal based on the performance data which are supplied from the microcomputer 70 via the bus B in response to the depression and release of each key, the operations of tone color selecting members and effect applying members (not shown). The data storing circuit 60 stores the automatic performance data, which are to be read out by the microcomputer 70 and then supplied to the circuit 53 via the bus B. This circuit 53 generates the musical tone signal based on such automatic performance data. These musical tone signals generated from the circuits 51, 52 and 53 are mixed together and then supplied to an amplifier 54. Then, the output of amplifier 54 is supplied to a speaker 55, from which the corresponding musical tone will be generated.

Figure 3:
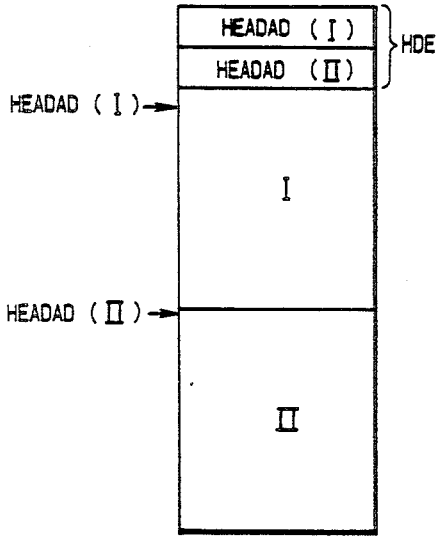
FIG. 3 shows storing areas of a performance data memory 63 shown in FIG. 1.
Figure 4:
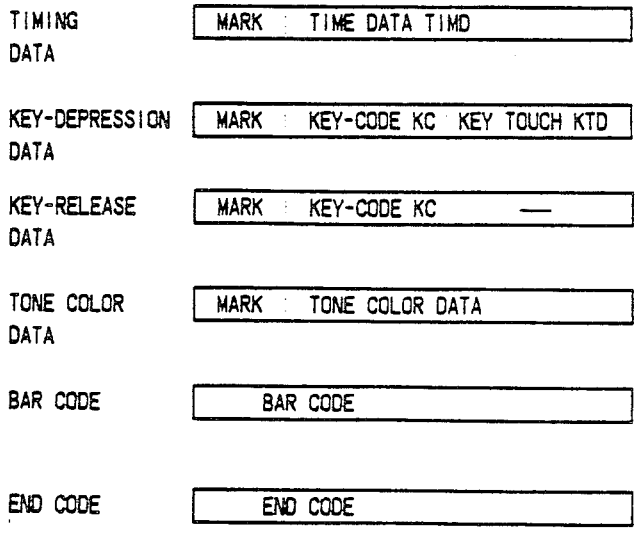
FIG. 4 shows data formats of performance data.

Meanwhile, the data storing circuit 60 is configured by a rhythm pattern data memory 61, a performance data memory 62 and a buffer register 63. The memory 61 is constructed by a read only memory (ROM) which stores series of the rhythm pattern data of one bar in time series by every rhythm kind. The memory 62 is constructed by a random access memory (RAM) having a head data area HDE, storing areas I and II both having the same storing capacity as shown in FIG. 3. The head data area HDE stores head address HEADAD(I) of area I and head address HEADAD(II) of area II. In addition, each of the areas I and II has a plenty of storing positions APM(ADR) whose address is designated by an address ADR which will be described later. Each storing position APM(ADR) stores the following kinds of automatic performance data which have data formats as shown in FIG. 4.

Timing data consisting of an identification mark indicating that this data are timing data; and time data TIMD indicative of lapse of time starting from the head timing of bar.

Key-depressing data consisting of an identification mark indicating that this data are key-depression event data of the keyboard 10; a key code KC indicative of the depressed key; and touch data KTD indicative of the initial key touch (tone volume level).

Key-release data consisting of an identification mark indicating that this data are key-release event data of the keyboard 10; and the key code KC indicative of the released key.

Tone color data consisting of an identification mark indicating that this data are tone color data; and tone color data indicative of the tone color which is selected by the tone color selecting switch 23.

Bar code which indicates that the progressing timing of automatic performance corresponds to the timing of bar end.

End code indicative of the end timing of automatic performance.

The microcomputer 70 is configured by a program memory 71, a central processing unit (CPU) 72 and a working memory 73. The program memory 71 is constructed by the ROM for storing main program, rhythm interrupt program and its subprograms. When a power switch (not shown), the CPU 72 starts to execute the main program which will be repeatedly executed until the power switch is turned off. When the tempo oscillator 40 supplies the tempo clock to the CPU 72, the CPU 72 breaks the execution of main program and then interruptedly executes a rhythm interrupt program. The working memory 73 is constructed by the RAM which temporarily stores plural data and flags which are necessary to execute the foregoing programs. These data and flags are described as follows (1) Rhythm run flag RUN . . . The rhythm tone is generated when this flag RUN takes the value "1", while the generation of rhythm tone is stopped when this flag RUN takes the value "0".

(2) Play flags PLY1 and PLY2 . . . When the flag PLY1 takes the value "1", the automatic performance can be played based on the performance data stored in the area I of performance data memory 62. Next, when the start switch 28 is depressed while the value of flag PLY1 is at "1", the automatic performance is started to be played. Similarly, when the flag PLY2 takes the value "1", the automatic performance can be played based on the performance data stored in the area II.

(3) Record flags REC1 and REC2 . . . When the flag REC1 takes the value "1", the data can be written into the area I. Thereafter, when the start switch 28 is depressed or when the key is turned on in the keyboard 10, the area I starts to store the data. Similarly, when the flag REC2 takes the value "1", the data can be written into the area II.

(4) Synchro-start flag SST . . . In the case where the flag SST takes the value "1", the rhythm tone is started to be generated at the same time when the key is depressed in the start timing of writing the performance data.

(5) Record check flags DTARI1 and DTARI2 . . . When the performance data are written into the area I, the value of flag DTARI1 is set to "1". Similarly, when the performance data are written into the area II, the value of flag DTARI2 is set to "1".

(6) Stop reserve flag SRF . . . When the flag SRF takes the value "1" in the automatic performance, the automatic performance is stopped at the next bar end timing. When the flag SRF takes the value "1" in the data writing operation, an end code is written into the performance data memory 62 at the next bar end timing so that the data writing operation will be ended.

(7) Address data ADR1 and ADR2 . . . These two address data ADR1 and ADR2 are both outputted to address terminals of the performance data memory 62. The address of area I is designated by the address data ADR1, while the address of area II is designated by the address data ADR2.

(8) Mode data M1 and M2 . . . The value of mode data M1 is changed to "1", "2" and "0" in a circulating manner at every time when the track switch **26*a*** is depressed. In response to this mode data M1, the following operation modes are determined:

"1". . . automatic performance mode of area I;
"2". . . data writing mode of area I; and
"0". . . normal performance mode.

Similarly, the value of mode data M2 is changed to the above values "1", "2" and "0" in the circulating manner at every time when the track switch **26*b*** is depressed.

(9) Tempo count data TCNT . . . The value of this data TCNT is incremented at every time when the tempo oscillator 40 outputs the tempo clock signal. When this value reaches at "48", this value is reset to "0". In short, the value of this data TCNT changes from "0" to "47" so as to repeatedly count the number of tempo clock signals to be generated. This data TCNT indicate the progressing timing of one bar, so that the value "47" of this data TCNT corresponds to the bar end timing.

(10) Read data RDDT1 and RDDT2 . . . The read data RDDT1 are the data which are read from the area I, while the read data RDDT2 are the data which are read from the area II.

(11) Read timing data RDTIM1 and RDTIM2 . . . The data RDTIM1 are the timing data read from the area I, while the data RDTIM2 are the timing data read from the area II.

(B) Operation of First Embodiment

Next, description will be given with respect to the operations of electronic musical instrument shown in FIG. 1 in conjunction with FIGS. 5 to 13B.

(1) Normal Performance Mode

When the track switches **26*a* and 26*b* are operated so that the LEDs 27*a* and 27*b*** are lighted off, the normal performance mode is set. In this mode, the electronic musical instrument executes the normal performance function.

Figure 5:
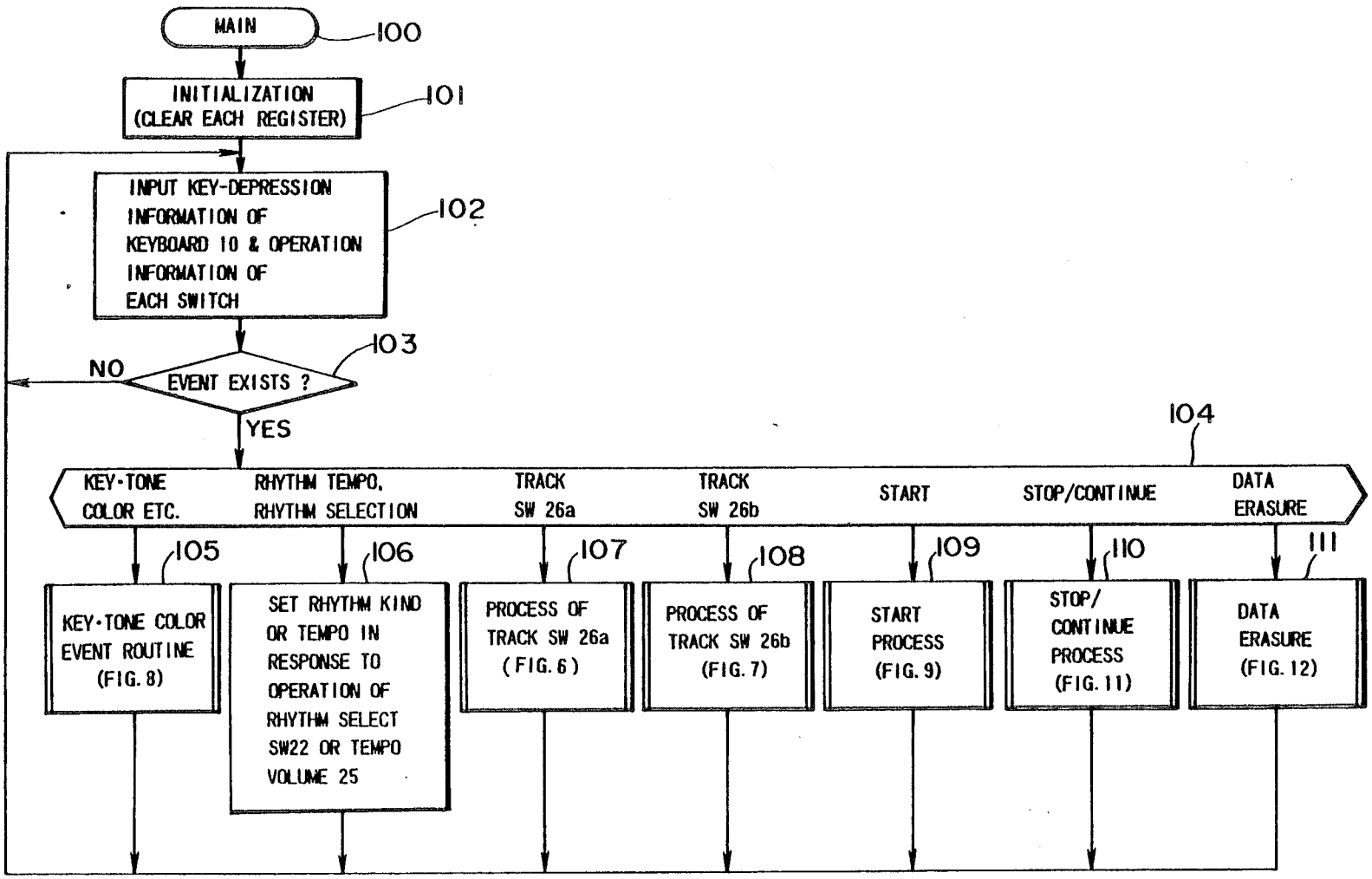
FIGS. 5 to 13B are flowcharts showing processes of a CPU 72 shown in FIG. 1.

More specifically, when the power switch is turned on, the CPU 72 starts to execute the main program shown in FIG. 5 from step 100. In step 101, the registers and flags of the working memory 73 are cleared so that the state of microcomputer 70 is set to its initial state. After such initialization in step 101, the CPU 72 scans the key switches of key switch circuit **10*a* and switching members of switching circuit 20*a* to thereby read in the key-depression and key-release information (i.e., key information) concerning the key operations of keyboard 10 and the operation information of switches of the console panel 20 via the bus B in step 102. In step 103, by using the working memory 73 based on the read key information and operation information, the CPU 72 judges the presence or absence of the key-depression or key-release events of the keyboard 10 and operation events of the console panel 20. When not key is depressed or released in the keyboard 10 and no switch is operated in the console panel 20, the judgement result of this step 103 turns to "NO" which means that there is no event. Then, the processing returns to step 102, so that the circulating processes consisting of steps 102 and 103 are continuously executed Next, when the player (or user) depresses the track switch 26*a*, the judgement result of step 103 turns to "YES" so that the processing proceeds to step 104 wherein the kind of event is judged. In this case, there is the on-event of track switch 26*a*, so that the processing proceeds to step 107**.

Figure 6:
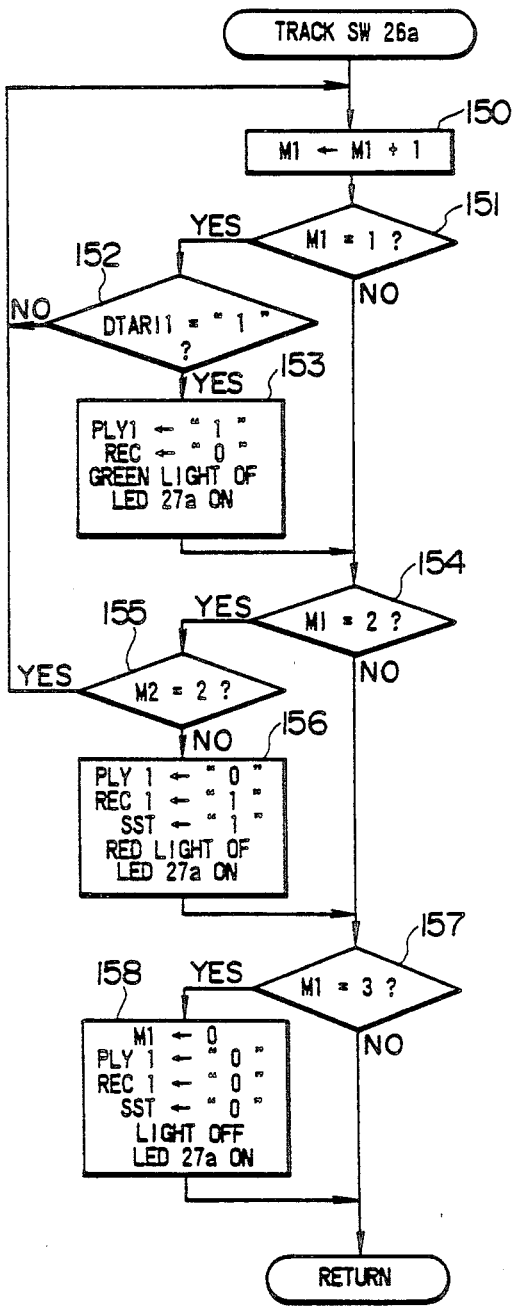

FIG. 6 is a flowchart of the process of this step 107. In first step 150, the value of mode data M1 is incremented. In next step 151, it is judged whether this value of mode data M1 is equal to "1" or not. If the judgement result of this step 151 is "YES", the processing proceeds to step 154. On the other hand, if the judgement result of step 151 is "NO", the processing proceeds to step 154. In step 152, it is judged whether the value of record check flag DTARI1 is equal to "1" or not. If the judgement result of this step 152 is "YES", the processing proceeds to step 153. On the other hand, if the judgement result of step 152 is "NO", the processing returns to step 150.

In step 153, the value "1" is set to the play flag PLY1 and the value "0" is set to the record flag REC 1 so that the green light of LED 27*a* will be lighted on. In next step 154, it is judged whether the value of mode data M1 is equal to "2" or not. Then, the processing proceeds to step 155 based on the judgement result "YES" of this step 154, while the processing proceeds to step 157 based on the judgement result "NO" of step 154. In step 155, it is judged whether the value of mode data M2 is equal to "2" or not. Then, the processing proceeds to step 156 based on the judgement result "NO" of this step 155, while the processing returns to step 150 based on the judgement result "YES" of step 155. In step 156, the value "0" is set to the play flag PLY1 and the value "1" is set to both of the record flag REC1 and the synchro-start flag SST so that the red light of LED 27*a* will be lighted on. Thereafter, the processing proceeds to step 157 wherein it is judged whether the value of mode data M1 is equal to "3" of not. Then, the processing proceeds to step 158 based on the judgement result "YES" of this step 157, while the processing returns to step 102 shown in FIG. 5 based on the judgement result "NO" of step 157. In step 158, the value "0" is set to the mode data M1 and all of the play flag PLY1, record flag REC1 and synchro-start flag SST are cleared so that the LED 27*a* is lighted off. After executing step 158, the processing returns to step 102.

As described above, every time the track switch 26*a* is depressed, the value of mode data M1 is incremented (in step 150). When the value of mode data M1 reaches at "3", this value is reset to "0" in step 158. In response to the value of mode data M1, the flag setting and the lighting on or off of LED 27*a* are executed (in steps 153, 156 and 158), whereby the operation mode will be determined.

However, in the case where any performance data have not been written into the area I of memory 62 yet when the mode data M1 take the value "1" (i.e., automatic performance mode), the judgement result of step 152 turns to "NO" so that the processing returns to step 150 wherein the value of mode data M1 is charged to "2". In short, when any performance data are not written in the area I, the value of mode data M1 is directly jumped to "2" from "0". In such case, it is impossible to set the value of mode data M1 to "1". In the case where the value "2" has been already set to the mode data M2 by the track switch 26*b* when the mode data M1 takes the value "2" (i.e., data writing mode), the judgement result of step 155 turns to "YES" so that the processing proceeds to step 150 wherein the value of mode data M1 is incremented again. In short, when the mode data M2 take the value "2", it is impossible to set the value "2" to the mode data M1. This operation prevents the same data from being written into both areas I and II.

Figure 7:
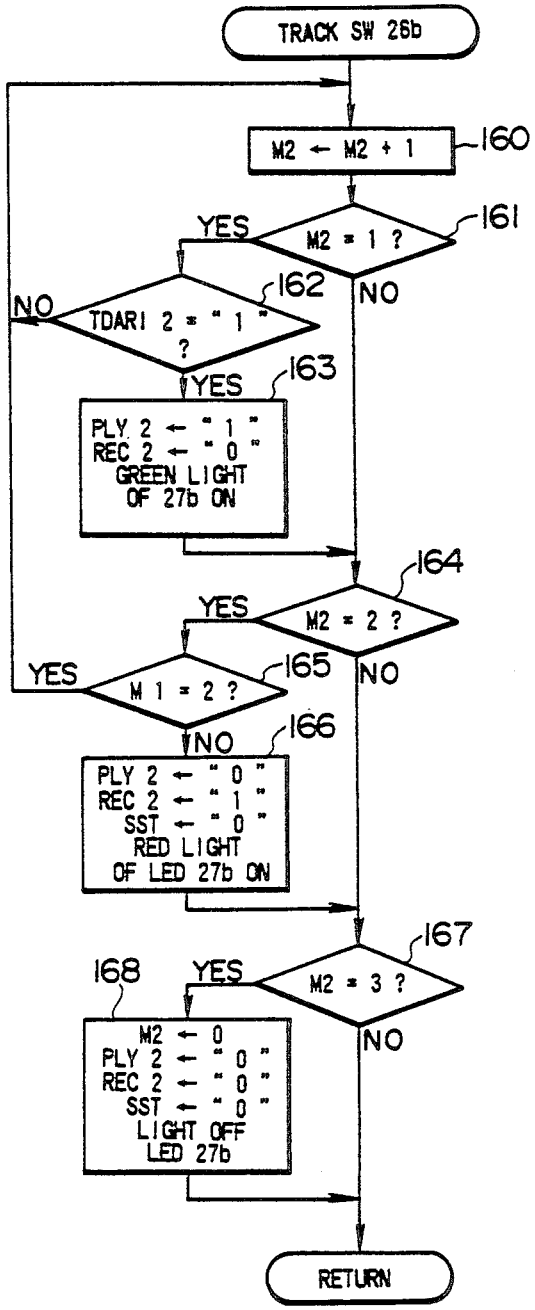

The above-mentioned processes are executed by the CPU 72 when the track switch 26*a* is operated. Meanwhile, when the track switch 26*b* is operated, the processing proceeds from step 104 to step 108 shown in FIG. 5. FIG. 7 shows the process of step 108. The processes in FIG. 7 are similar to those in FIG. 6, wherein M2 is used instead of M1. Therefore, the detailed description of the processes in FIG. 7 will be omitted.

Next, when both of the LEDs 27*a* and 27*b* are lighted off by operating the track switches 26*a* and 26*b*, the value "0" is set to all of the play flags PLY1, PLY2 and record flags REC1 and REC2 (in step 158 shown in FIG. 6 and step 168 shown in FIG. 7) so that the normal performance mode will be selected. In this case, when the player uses the keyboard 10 and console panel 20 to thereby play the performance, the corresponding musical tones are generated from the speaker 55.

Figure 8A:
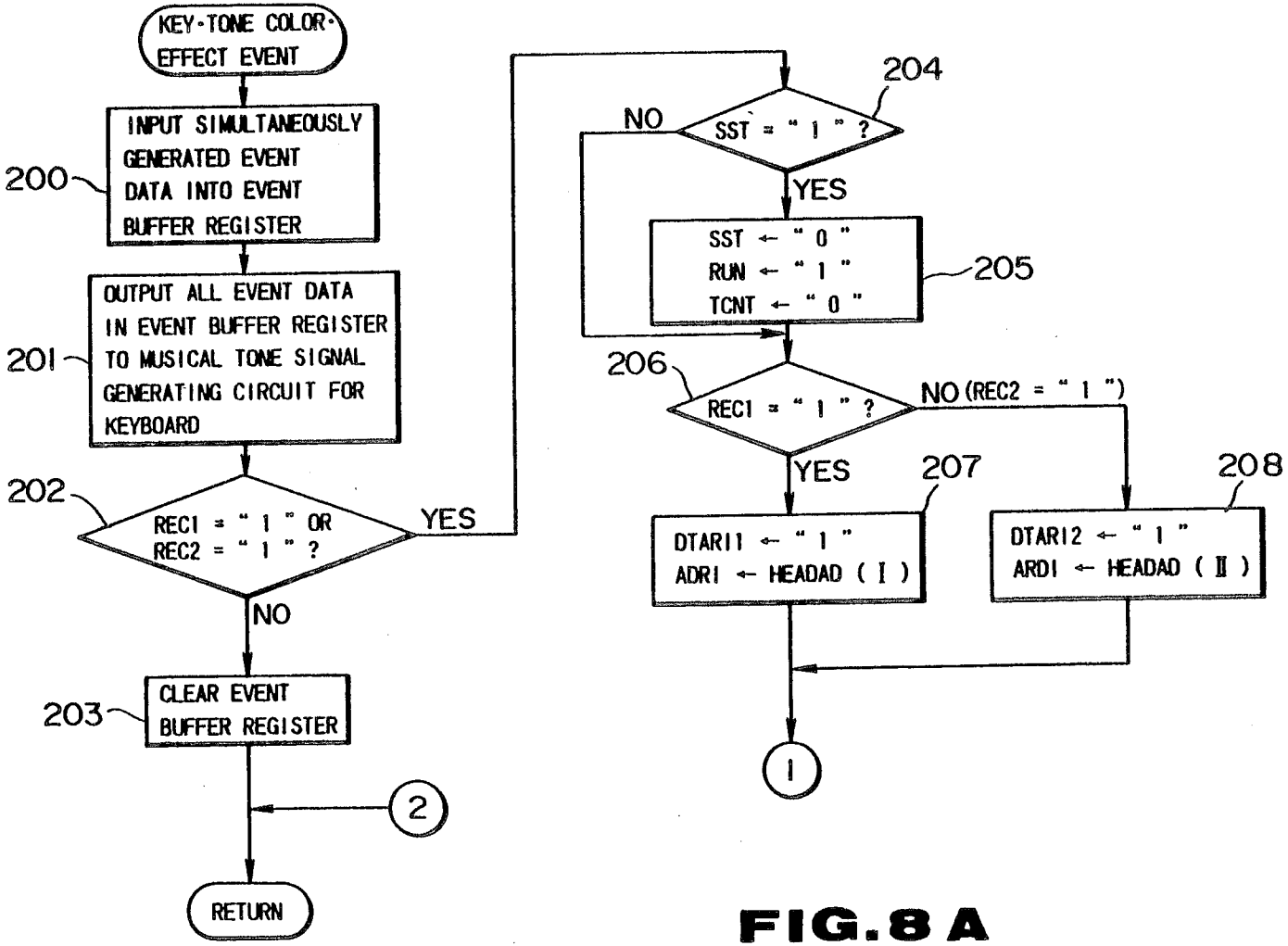
Figure 8B:
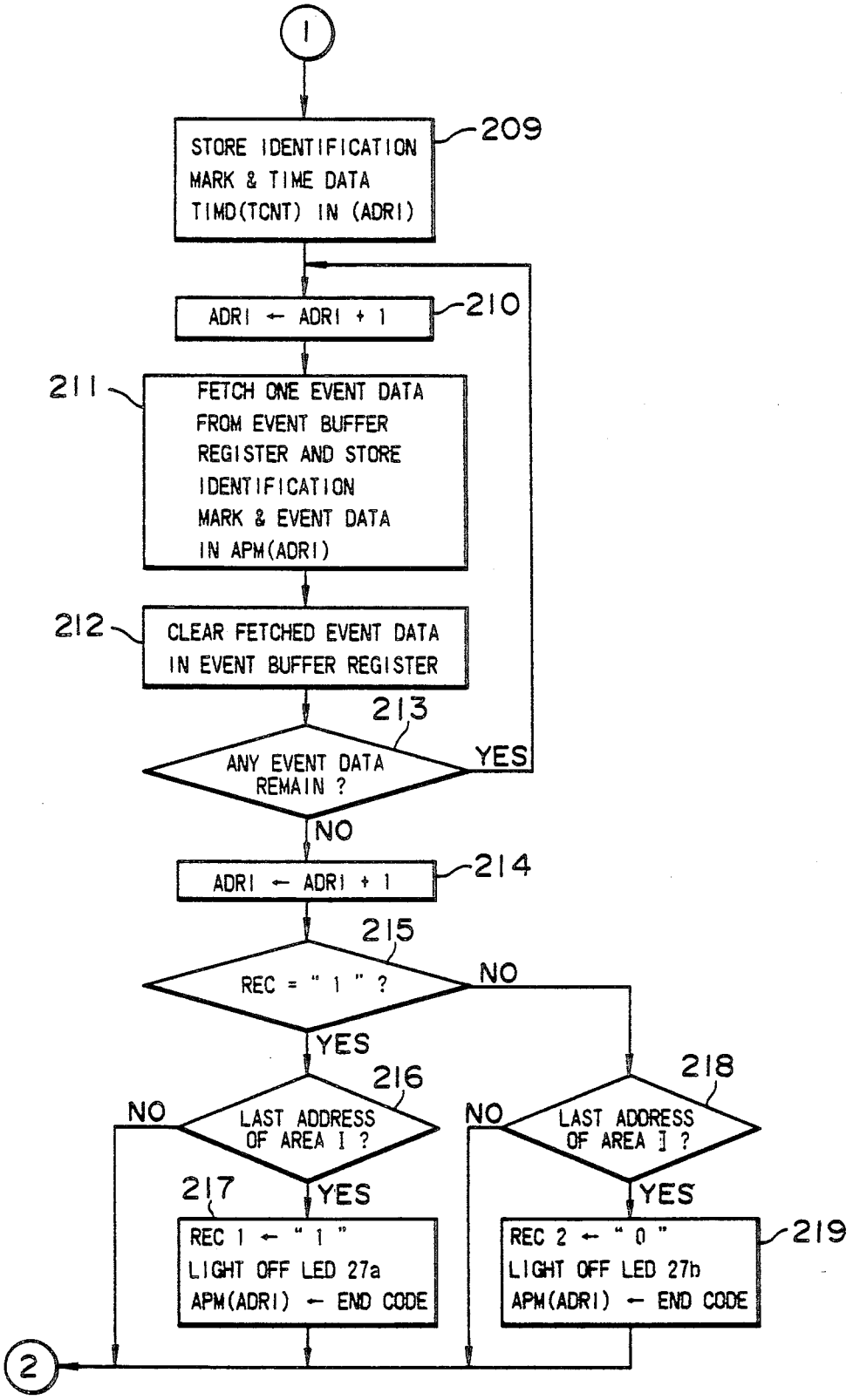

More specifically, when any key of the keyboard 10 is depressed, the judgement result of step 103 shown in FIG. 5 turns to "YES" so that the processing proceeds to the key, tone color event routine shown in FIGS. 8A and 8B via step 104. FIGS. 8A and 8B are flowcharts both showing this routine, wherein the simultaneously generated event data are inputted into the event buffer register 63. In this case this register 63 inputs the key-depression data of depressed key consisting of the key code KC, key touch data KTD and identification mark (see FIG. 4). In next step 201, the event data (i.e., key-depression data) stored in the event buffer register 63 are outputted to the musical tone signal generating circuit 52. Thus, the musical tone of depressed key will be generated. Then, it is judged whether the value "1" is set to one of the record flags REC1 or REC2 or not in step 202. If the judgement result of this step 202 is "NO", the processing proceeds to step 203 wherein the event buffer register 63 is cleared. Then, the processing returns to step 102 shown in FIG. 5.

As described before, when the depressed key of keyboard 10 is released, the processing proceeds from step 103 to step 200 (shown in FIGS. 8*a* and 8*b*) via step 104, whereby the key-release data consisting of the key code KC and identification mark of the released key are inputted to the event buffer register 63. Such key-release data are outputted to the musical tone signal generating circuit 52 in step 201. Thus, the generation of the musical tone corresponding to the released key will be stopped. Next, the processing returns to step 102 via steps 202 and 203.

Next, the tone color selecting switch 23 is operated, the data indicative of the operated tone color selecting switch are written into the event buffer register 63 in step 200, and then such data are outputted to the musical tone signal generating circuit 52 wherein the tone color corresponding to the operated tone color selecting switch is set. Similarly, when the master volume 24 is operated, the data indicative of the operation amount of master volume 24 are set in the circuit 52 so that the tone volume of musical tone to be generated will be changed.

Figure 9:
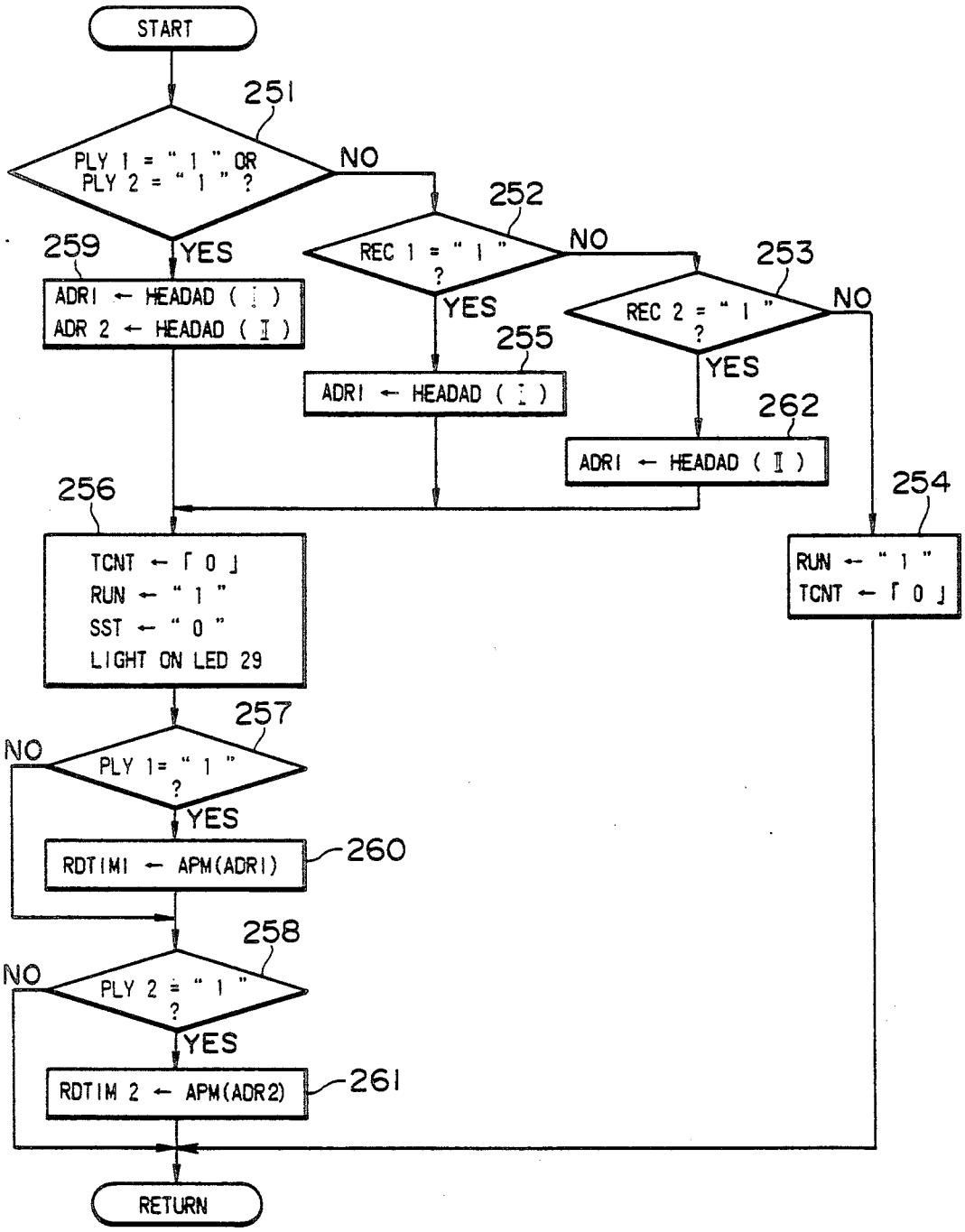

In order to generate the rhythm tone, the start switch 28 must be operated. When the start switch 28 is operated, the judgement result of step 103 turns to "YES" so that the processing proceeds to a start process routine of step 109 (see FIG. 9) via step 104. FIG. 9 is a flowchart showing this start process routine, wherein it is judged whether the value "1" is set to one of the play flags PLY1 or PLY2 or not in step 251. In this case, the judgement result of this step 251 turns to "NO" so that the processing proceeds to step 252. In step 252, it is judged whether the record flag REC1 takes the value "1" or not. This judgement result of step 252 turns to "NO" so that the processing proceeds to step 253 wherein the record flag REC 2 takes the value "1" or not. This judgement result of step 253 turns to "NO" so that the processing proceeds to step 254 wherein the value "1" is set to the rhythm run flag RUN and the value of tempo counter data TCNT is cleared. Then, the processing returns to step 102 (shown in FIG. 5).

As described above, when the switch 28 is operated in the normal performance mode, the value "1" is set to the rhythm run flag TUN and the value of tempo count data TCNT is cleared. Thereafter, the rhythm tone is generated based on the tempo clock outputted from the tempo oscillator 40.

Figure 10B:
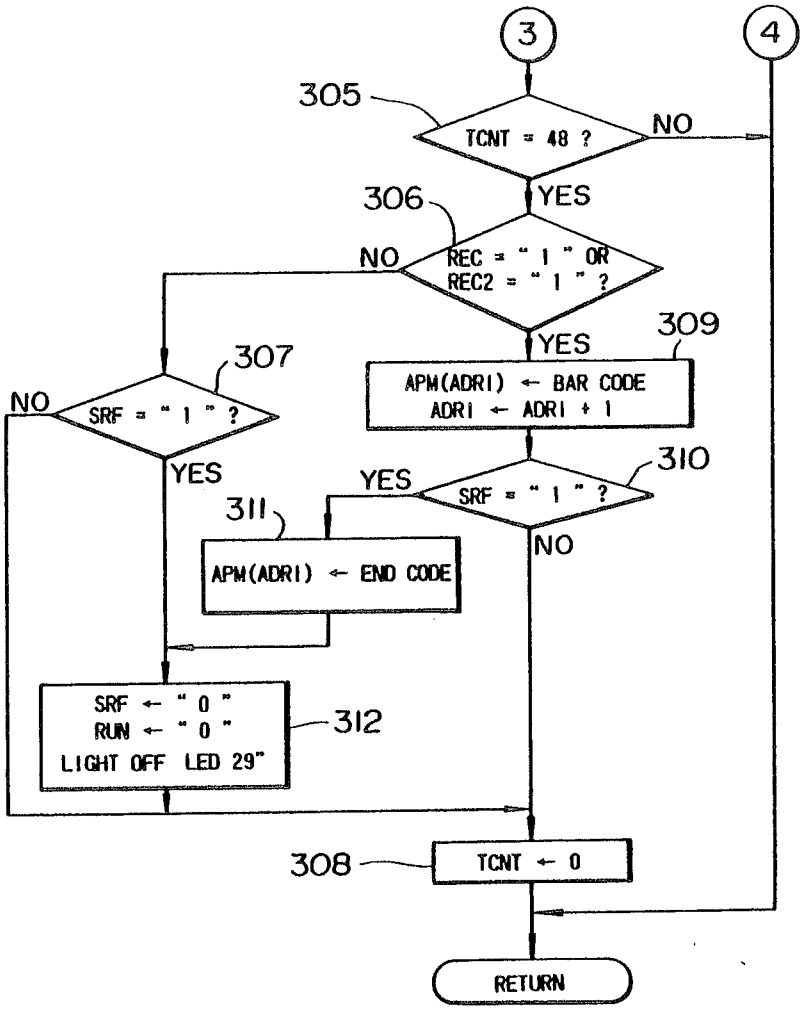
Figure 10A:
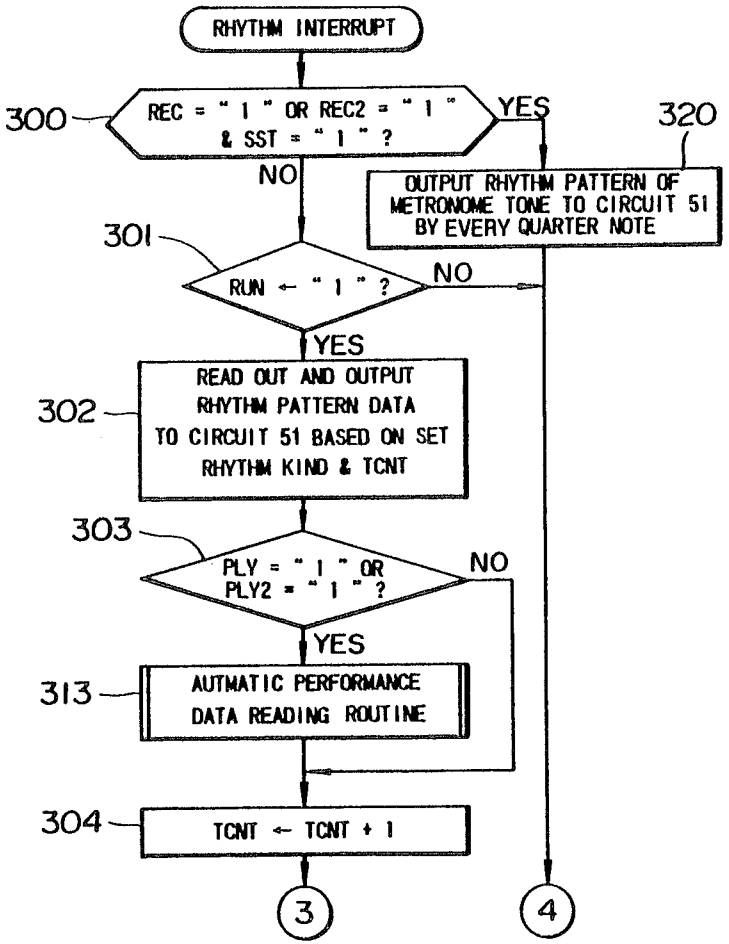

More specifically, when the tempo oscillator 40 outputs the tempo clock, the process of CPU 72 is interrupted so that the processing thereof will proceed to a rhythm interrupt process routine shown in FIGS. 10A and 10B. In first step 300 of this routine, it is judged whether one of the record flags REC1 or REC2 takes the value "1" and the synchro-start flag SST takes the value "1" or not. If the judgement result of this step 300 turns to "NO", the processing proceeds to step 301 wherein it is judged whether the rhythm run flag RUN takes the value "1" or not. Then, the processing returns to the main routine shown in FIG. 5 based on the judgement result "NO" of this step 301, while the processing proceeds to step 302 based on the judgement result "YES" of step 301. In step 302, the rhythm pattern data are read from the rhythm pattern memory 61 based on the data indicative of the rhythm kind presently set in the working memory 73 and the tempo count data TCNT. The read rhythm pattern data are outputted to a rhythm tone signal generating circuit 51. Based on such rhythm pattern data, each percussive musical tone signal generating circuit is driven so that the corresponding rhythm tone will be generated.

Next, it is judged whether one of the play flags PLY1 and PLY2 takes the value "1" of not in step 303. In this case, the judgement result of this step 303 turns to "NO" so that the processing proceeds to step 304 wherein the value of tempo count data TCNT is incremented. In next step 305, it is judged whether the tempo count data TCNT take the bar end value "48" or not. The judgement result of this step 303 must be turned to "NO", so that the processing will return to the main routine shown in FIG. 5.

Thereafter, every time the tempo clock is generated, the rhythm tone is generated by executing the process of step 302, while the value of tempo count data TCNT is incremented by executing the process of step 304. When the value of tempo count data TCNT reaches at "48", the judgement result of step 305 turns to "YES" so that the processing proceeds to step 306 wherein it is judged whether the record flag REC1 or REC2 takes the value "1" or not. In this case, the judgement result of this step turns to "NO", so that the processing proceeds to step 307 wherein it is judged whether the stop reserve flag SRF takes the value "1" or not. This judgement result of step 307 must be "NO" so that the processing proceeds to step 308 wherein the value of tempo count data TCNT is cleared. Then, the processing returns to the main routine.

Figure 11:
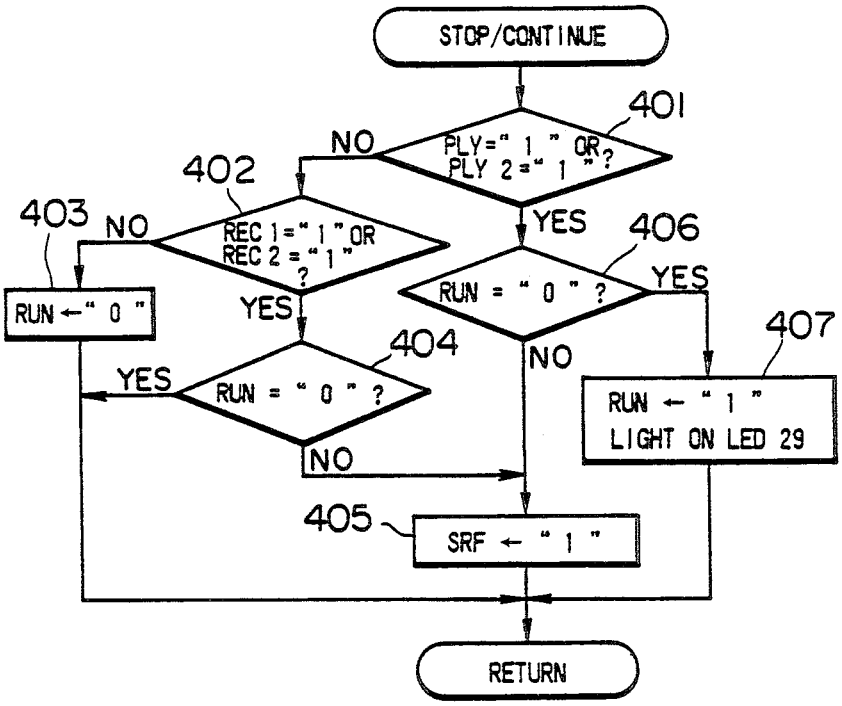

Due to the above-mentioned processes, the rhythm tone will be generated. Next, in order to stop generating the rhythm tone in the normal performance mode, the stop/continue switch 30 must be operated. When this switch 30 is operated, the processing proceeds from step 103 to a stop/continue process routine of step 110 via step 104. FIG. 11 is a flowchart showing this stop/continue routine. In first step 401, it is judged whether one of the play flags PLY1 and PLY2 takes the value "1" or not. The judgement result of this step 401 must turn to "NO" so that the processing proceeds to step 402 wherein it is judged whether the record flag REC1 or REC2 takes the value "1" or not. If the judgement result of this step 402 is "NO", the processing proceeds to step 403 wherein the rhythm run flag RUN is reset. After this flag RUN is reset, the process of step 302 shown in FIG. 10A must not be executed so that the generation of rhythm tone will be stopped. Then, the processing returns to the main routine.

Next, when the rhythm selecting switch 22 is operated, the processing proceeds from step 103 to step 106 via step 104. In step 106, the data indicative of the rhythm kind are set within the working memory 73 in response to the operated rhythm selecting switch 22. Thereafter, the reading of rhythm pattern data memory 61 is executed based on such set data. In the case where the tempo volume 25 is operated, the processing also proceeds to step 106, whereby the oscillation frequency of the tempo oscillator 40 is set in response to the operation amount of the tempo volume 25.

(2) Data Writing Mode

In this data writing mode, the performance data are written into the area I or II of the performance data memory 62. In order to write the performance data in the area I, the LED **27*b* is lighted off by operating the track switch 26*b* and then the red light of LED 27*a* is lighted on by operating the track switch 26*a*. When the player uses the keyboard 10 and console panel 20 to thereby play the performance, the performance data corresponding to such performance are sequentially written into the area I. In this case, there are two start methods. In a first start method where the start switch 28 is not operated, the data writing and the generation of rhythm tone are started at the same time when the key is depressed. In a second start method, the data writing and the generation of rhythm tone are started at the same time when the start switch 28** is operated.

In order to write the performance data in the area II, the LED **27*a* is lighted off by operating the track switch 26*a* and then the red light of LED 27*b* is on by operating the track switch 26*b*. Then, the performance is played by using the keyboard 10 and console panel 20**.

Hereinafter, description will be given with respect to the processes of CPU 72 in this data writing mode. First, when the LED **27*b* is lighted off by operating the track switch 26*b*, the value "0" is set to all of the mode data M2, play flag PLY2, record flag REC2 and synchro-start flag SST in step 168 shown in FIG. 7. Next, when the red light of LED 27*a* is on by operating the track switch 26*a*, the value "2" is set to the mode data M1, the value "0" is set to the play flag PLY1, and the value "1" is set to both of the record flag REC1 and synchro-start flag SST in steps 154 and 156 shown in FIG. 6**.

When the value "1" is set to the record flag REC1 and synchro-start flag SST, a metronome tone is generated by every timing of quarter note in order to inform the player of the present tempo. More specifically, when the tempo oscillator 40 outputs the tempo clocks so that the CPU 72 enters into the interrupt process as shown in FIGS. 10A and 10B, the judging process of step 300 is executed at first. In this case, the judgement result of step 300 turns to "YES" so that the processing proceeds to step 320 wherein the rhythm pattern of metronome tone is read from the rhythm pattern memory 61 by every timing of quarter note. The read rhythm pattern is outputted to the rhythm tone signal generating circuit 51, from which the metronome tone is generated by every quarter note.

Next, when the key is depressed, the judgement result of step 103 (shown in FIG. 5) turns to "YES" so that the event routine shown in FIGS. 8A and 8B will be executed via step 104. In this routine, the processes of steps 200 and 201 are executed, so that the musical tone of depressed key will be generated. Next, the judgement result of step 202 turns to "YES", hence, the processing proceeds to step 204 wherein it is judged whether the synchro-start flag SST takes the value "1" or not. This judgement result of step 204 must turn to "YES", and then the processing proceeds to step 205 wherein the value "0" is set to the synchro-start flag SST, the value "1" is set to the rhythm run flag RUN, and the value of tempo count data TCNT is cleared. After the synchro-start flag SST takes the value "1", the generation of metronome tone is stopped. In addition, after the rhythm run flag RUN takes the value "1", the rhythm tone is started to be generated. Next, in step 206, it is judged whether the record flag REC1 takes the value "1" or not. In this case, the judgement result of step 206 must turn to "YES" so that the processing proceeds to step 207 wherein the value "1" is set to a record check flag DTARI1 and the head address data HEADAD(I) (see FIG. 3) are set as address data ADR1. Then, the processing proceeds to step 209 (shown in FIG. 8B). Meanwhile, when the value of record flag REC2 is equal to "1" (i.e., in the writing mode of area II), the judgement result of step 206 turns to "NO" so that the processing proceeds to step 208 wherein the value "1" is set to a record check flag DTARI2 and the head address data HEADAD(II) are set as address data ADR1.

In the next step 209, the timing data consisting of the identification mark and time data TIMD (see FIG. 4) are written into a storing position (APM(ADR1) indicated by the address data ADR1 within the memory 62. Herein, the tempo count data TCNT are set as the time data TIMD whose value is therefore equal to "0" (see step 205). Next, the value of address data ADR1 is incremented in step 210. In step 211, first event data are read from the event buffer register 63, and then read first event data with the identification mark are written into the storing position APM(ADR1) in the memory 62. Then, such first event data are cleared in step 212, and the processing proceeds to step 213 wherein it is judged whether any event data are written in the event buffer register 63 or not. If the judgement result of this step 213 is "YES", the processes of step 210 and 212 are executed again. In the contrary, when the judgement result of step 213 is "NO", the value of address data ADR1 is incremented in step 214. In a next step 215, it is judged whether the value of record flag REC1 is equal to "1" or not. When the judgement result of this step 215 is "YES", the processing proceeds to step 216 wherein it is judged whether the address data ADR1 designates the last address of area I or not. Then, the processing returns to step 102 (shown in FIG. 5) based on the judgement result "NO" of this step 216, while the processing proceeds to step 217 based on the judgement result "YES" of step 216. In step 217, the record flag REC1 is reset, the LED 27*a* is lighted off, and the end code is written into the storing position APM(ADR1) of the memory 62. Thereafter, the processing returns to step 102. Meanwhile, when the judgement result of step 215 is "NO" wherein the record flag REC2 takes the value "1", the processing proceeds to step 218 wherein it is judged whether address data ADR1 designate the last address of area II or not. If the judgement result of this step 218 is "YES", a process of step 219 similar to the process of step 217 is executed.

As described above, when the mode data M1 takes the value "2", the mode data M2 takes the value "0" and then the key is depressed, the value "1" is set to the rhythm run flag RUN (in step 205) so that the rhythm tone is started to be generated. In addition, the event data corresponding to the depressed key are written into the area I. Thereafter, every time the key is depressed or any switch of the console panel 20 is operated, the processes of steps 209 to 213 are executed so that the performance data are written into the area I.

At the bar end timing, the judgement result of step 305 shown in FIG. 10B turns to "YES" so that the processing proceeds to step 306. In this case, the judgement result of step 306 turns to "YES" so that the processing proceeds to step 309 wherein the bar code is written into the storing position APM(ADR1) of memory 62 and then the value of address data ADR1 is incremented.

Next, when the address data ADR1 designate the last address of area I, the process of step 217 is executed so that the data writing mode is ended. In order to complete the data writing mode before the process of step 217 is executed, the stop/continue switch 30 must be operated.

When this switch 30 is operated, the processing proceeds to the stop/continue process shown in FIG. 11, wherein the processing proceeds to step 404 via steps 401 and 402. In step 404, it is judged whether the rhythm run flag RUN takes the value "0" or not. This judgement result of step 404 must be turned to "NO", so that the processing proceeds to step 405 wherein the value "1" is set to the stop reserve flag SRF. Then, the processing returns to the main routine. At the end timing of the bar where the stop reserve flag SRF takes the value "1", the judgement result of step 310 (shown in FIG. 10B) turns to "YES" so that the processing proceeds to step 311 wherein the end code is written into the storing position APM(ADR1) of the memory 62. In a next step 312, both of the stop reserve flag SRF and rhythm run flag RUN are reset and the LED 29 is lighted off. Then, the processing proceeds to step 308 wherein the value of tempo count data TCNT is cleared. Thereafter, the processing returns to the main routine.

In the above-mentioned processes, the data writing and the generation of rhythm tone are started by depressing the key after the mode is set. However, it is possible to start the data writing and the generation of rhythm tone by operating the start switch 28 after the mode is set.

For example, when the start switch 28 is operated after the value of mode data M1 is set to "2" and the value of mode data M2 is set to "0", the processing proceeds to step 255 via steps 251 and 252 in FIG. 9. In step 255, the head address data HEADAD(I) are set as the address data ADR1. Next, when the processing proceeds to step 256 wherein the value of tempo count data TCNT is cleared, the rhythm run flag RUN is set, the synchro-start flag SST is reset and the LED 29 is lighted on. Then, the processing returns to the main routine via steps 257 and 258.

As described above, when the start switch 28 is operated after the value "2" is set to the mode data M1, the address data ADR1 are set identical to the head address of area I and the value "1" is set to the rhythm run flag RUN so that the generation of rhythm tone is started. Thereafter, when the performance is played by depressing the keys, the performance data are sequentially written into the area I as described before.

Similar to the writing of area I as described heretofore, the writing of area II will be executed.

Figure 12:
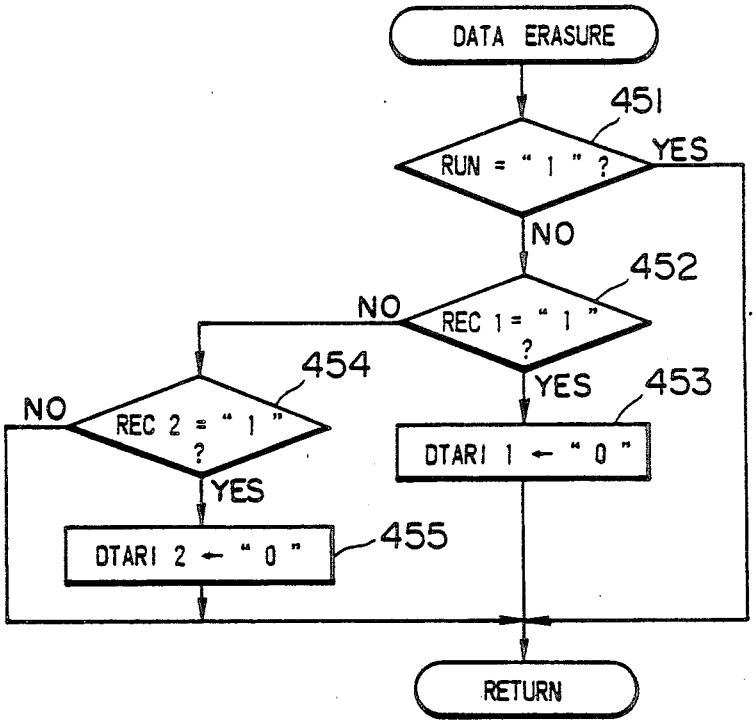

In order to erase the all data within the area I or area II, the delete switch 31 shown in FIG. 2 must be operated. At this time, the judgement result of step 103 turns to "YES" so that the processing proceeds to step 111 via step 104, hence, the data erasure process will be executed. FIG. 12 is a flowchart showing this data erasure process. In a first step 451 shown in FIG. 12, it is judged whether the value of rhythm run flag RUN is equal to "1" or not. If the judgement result of this step 451 turns to "YES", the processing returns to step 102. In short, when the rhythm tone is generated, the data can not be erased even if the delete switch 31 is operated. On the other hand, when the judgement result of step 451 turns to "NO", the processing proceeds to step 452 wherein it is judged whether the value of record flag REC1 is equal to "1" or not. When the judgement result of this step 452 is "YES" in the data writing mode of area I, the processing proceeds to step 453 wherein the value of record check flat DTARI1 is set equal to "0". Then, the processing returns to step 102. On the other hand, when the judgement result of step 452 is "NO". the processing proceeds to step 454 wherein it is judged whether the value of record flag REC2 is equal to "1" or not. When the judgement result of this step 454 is "YES" in the data writing mode of area II, the processing proceeds to step 455 wherein the value of record check flag DTARI2 is set equal to "0". Then, the processing returns to step 102. When the writing mode is not set for the areas I and II at all so that the judgement result of step 454 turns to "NO", the processing directly returns to step 102.

(3) Automatic Performance Mode

In this mode, the automatic performance is played based on the performance data read from the memory 62. In the case where the automatic performance is played based on the performance data stored in the area I of memory 62, the value of mode data M2 is set to "0" and the value of mode data M1 is set to "1". On the other hand, in the case where the automatic performance is played based on the performance data stored in the area II, the value of mode data M1 is set to "0" and the value of mode data M2 is set to "1". Then, the start switch 28 must be operated.

Hereinafter, description will be given with respect to the case where the automatic performance is played based on the performance data stored in the area I. First, when the value of mode data M2 is set to "0", the process of step 168 shown in FIG. 7 is executed. Next, when the value of mode data M1 is set to "1", the judgement result of step 151 shown in FIG. 6 turns to "YES" so that it is judged whether the record check flag DTARI1 takes the value "1" or not in step 152. When the performance data are written in the area I so that the judgement result of this step 152 turns to "YES", the processing proceeds to step 153 wherein the play flag PLY1 is set, the record flag REC1 is reset and then the green light of LED 27*a* is on.

Next, when the start switch 28 is operated, the processing proceeds to step 251 shown in FIG. 9 wherein it is judged whether the play flag PLY1 or PLY2 takes the value "1" or not. In this case, the judgement result of this step 251 must be turned to "YES", so that the processing proceeds to step 259 wherein the head address data HEADAD(I) and HEADAD(II) are respectively set as the address data ADR1 and ADR2. Then, after executing the process of step 256, the processing proceeds to step 257 wherein it is judged whether the value of play flag PLY1 is set to "1" or not. This judgement result of step 257 must be turned to "YES", so that the processing proceeds to step 260 wherein the data stored in the storing position APM(ADR1) (designated by the address data ADR1, i.e., the head address data HEADAD(I)) are read out and then such read data are set as the read timing data RDTIM1. Next, the processing proceeds to step 258 wherein it is judged whether the value of play flag PLY2 is set to "1" or not. In this case, the judgement result of step 258 turns to "NO", hence, the processing returns to step 102 (shown in FIG. 5). When the automatic performance is played based on the performance data stored in the area II so that the judgement result of step 258 turns to "YES", the processing proceeds to step 261 wherein the data stored at the storing position APM(ADR2) designated by the address data ADR2 are read out and then set as read timing data RDTIM2.

As described above, when the automatic performance of area I is set and the start switch 28 is operated, the play flag PLY1 is set and then the rhythm run flag RUN is set. After these flags PLY1 and RUN are set, the automatic performance tone and rhythm tone are generated based on the tempo clock outputted from the tempo oscillator 40.

Figure 13A:
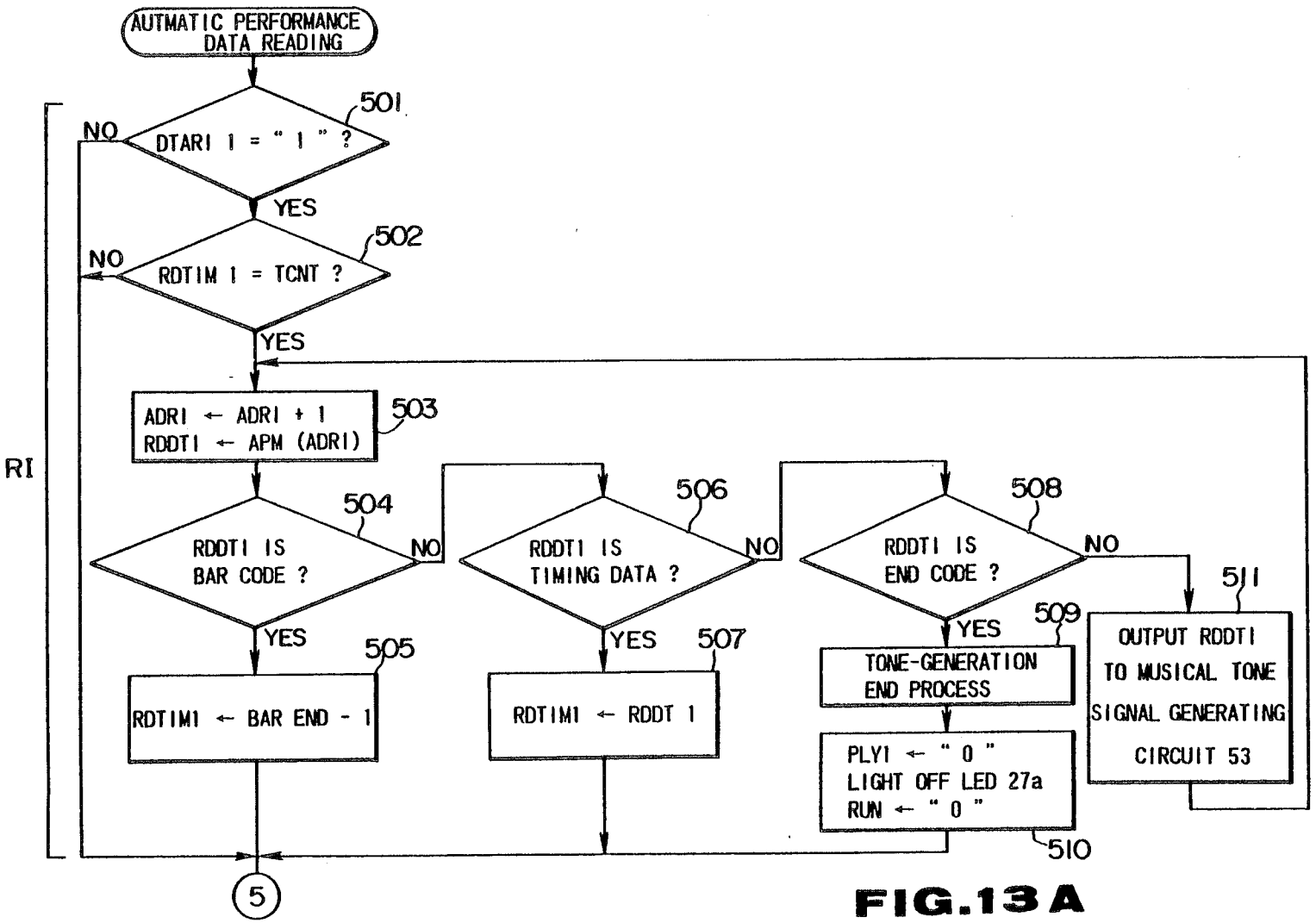
Figure 13B:
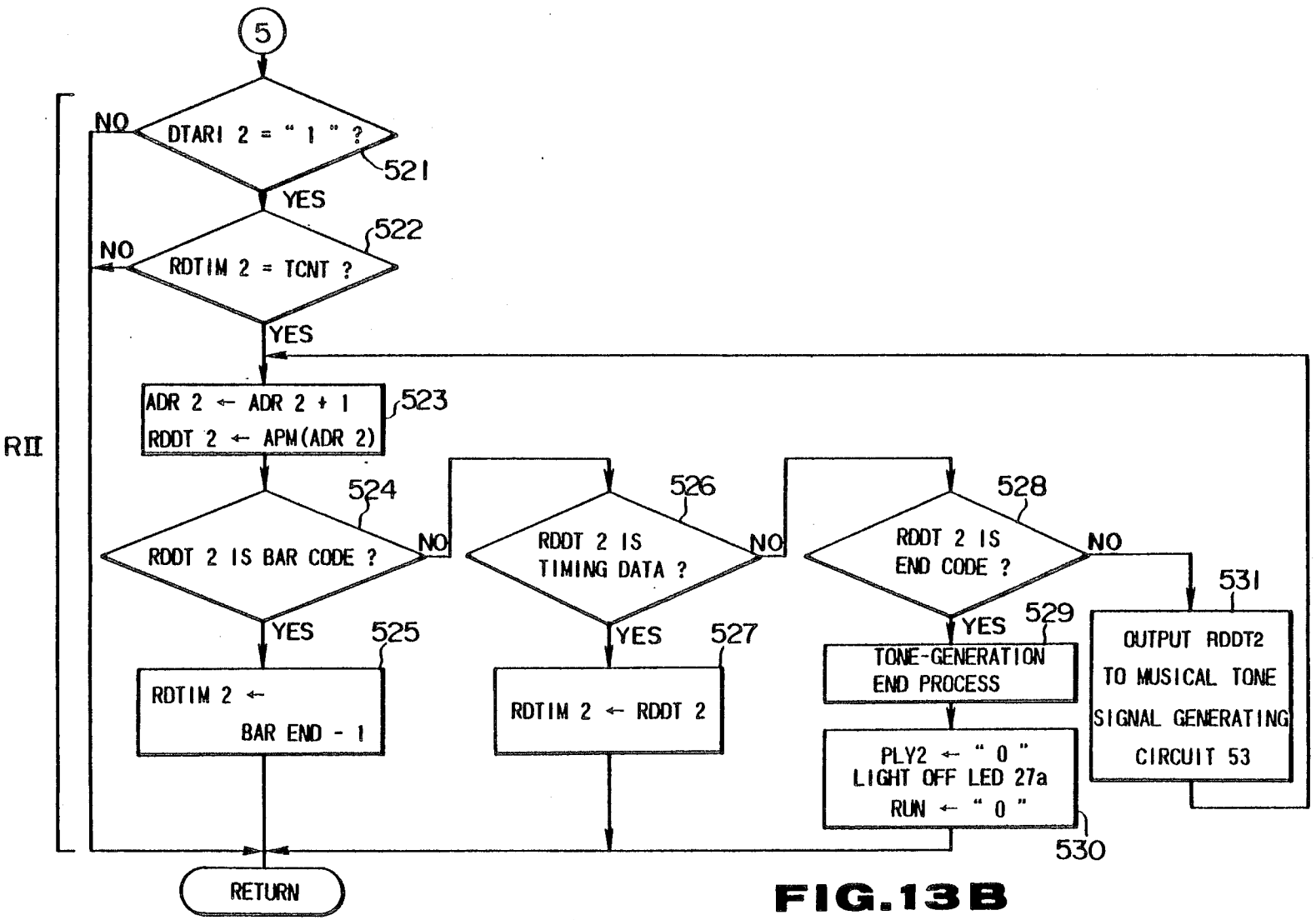

When the tempo clock is generated, the CPU 72 is interrupted so that the rhythm interrupt process as shown in FIG. 10 is executed. In this case, the processing passes through steps 300 and 301 and then the processing proceeds to step 302 wherein the rhythm tone is to be generated. Next, since the judgement result of step 303 turns to "YES", the processing proceeds to a automatic performance data reading routine in step 313. FIGS. 13*a* and 13*b* are flowchart showing this routine which includes a reading routine RI (see FIG. 13A) for reading the data in the area I and another reading routine RII (see FIG. 13B) for reading the data in the area II. The processes of routine RI are identical to those of routine RII, wherein some data or flags are only different.

In a first step 501 shown in FIG. 13A, it is judged whether the value of record check flag DTARI1 is equal to "1" or not. When there are no performance data in the area I so that the judgement result of this step 501 turns to "NO", the processing jumps over the routine RI and then proceeds to the routine RII (shown in FIG. 13B). On the contrary, when the judgement result of step 501 turns to "YES", the processing proceeds to step 502 wherein it is judged whether the value of tempo count data TCNT is identical to the value of read timing data RDTIM1 or not. If the judgement result of this step 502 is "NO", the processing directly proceeds to the routine RII. If the judgement result of step 502 is "YES", the processing proceeds to step 503 wherein the value of address data ADR1 is incremented and the data read from the storing position APM(ADR1) in the memory 62 are set as the read data RDDT1. In a next step 504, it is judged whether the read data RDDT1 designate the bar code or not. If the judgement result of this step 504 is "YES", the processing proceeds to step 505 wherein the value "1" is subtracted from the bar end value "48" to thereby obtain the value "47" which will be set as the read timing data RDTIM1, and then the processing leaves from the routine RI. On the contrary, when the judgement result of step 504 is "NO", the processing proceeds to step 506 wherein it is judged whether the read data RDDT1 are the timing data or not. If the judgement result of this step 506 is "YES", the read data RDDT1 are set as the read timing data RDTIM1 in step 507. On the other hand, if the judgement result of step 506 is "NO", the processing proceeds to step 508 wherein it is judged whether the read data RDDT1 designate the end code or not. If the judgement result of this step 508 is "YES", a tone-generation end process is executed in step 509. More specifically, the key-release data for commanding that the generation of musical tone must be stopped are outputted to the musical tone signal generating circuit 53. Thus, the generation of musical tone will be stopped. Then, the processing proceeds to step 510 wherein the play flag PLY1 is cleared, the LED 27*a* is lighted off and the rhythm run flag RUN is reset. Then, the processing leaves from the routine RI. On the other hand, if the judgement result of step 508 is "NO", the processing proceeds to step 511 wherein the read data RDDT1 are outputted to the musical tone signal generating circuit 53. Then, the processing returns to step 503.

As described above, due to the judging processes of steps 501 and 502, the tone-generation process will not be executed at all until the value of tempo count data TCNT coincides with the value of read timing data RDTIM1. When these two values coincide with each other, the next performance data are read from the area I (in step 503). When such read performance data designate the key-on event, such performance data are outputted to the musical tone signal generating circuit 53 in step 511, whereby the musical tone will be generated. Next, the processing returns to step 503 wherein the data are read out again. Then, if the read data designate the timing data, the process of step 507 is to be executed. Thereafter, the tone-generation process will not be executed until the value of tempo count data TCNT coincides with the value of read timing data RDTIM1. When these two values coincide with each other, the same tone-generation process as described above is executed. By repeatedly executing such processes, the automatic performance will be played.

Next, when the data read from the area I designate the bar code, the value "47" is set as the read timing data RDTIM1. As a result, the tone-generation process will not be executed until the bar end timing. At the next bar end timing, the data of area I are to be read out. In this case, the timing data or bar code is read from the area I. When the timing data are read from the area I, such data are not read out until the value of tempo count data TCNT coincides with the value of timing data. When the bar code is read from the area I, such data are not read out during the next one bar period.

In the case where the data read from the area I designate the end code, the processes of steps 509 and 510 are executed so that the automatic performance mode will be ended.

Above are the processes of routine RI. Due to these processes, the automatic performance will be played based on the performance data of area I. On the contrary, the processes of routine RII are provided for playing the automatic performance based on the performance data of area II. Therefore, the musical tone based on the performance data of area I is generated when the routine RI is only executed, while another musical tone based on the performance data of area II is generated when the routine RII is only executed. When both of the routines RI and RII are executed, the musical tones based on the performance data of areas I and II are simultaneously generated.

Next, in the case where the automatic performance is to be stopped in the middle of automatic performance (before the end code is read out), the stop/continue switch 30 must be operated. When this switch 30 is operated, the processing proceeds from step 104 shown in FIG. 5 to step 401 shown in FIG. 11. In this case, since the judgement result of step 401 turns to "YES", the processing proceeds to step 406 wherein it is judged whether the value of rhythm run flag RUN is equal to "0" or not. Since the judgement result of step 406 must be "NO", the stop reserve flag SRF takes the value "1" in step 405, and then the processing returns to step 102. When this flag SRF takes the value "1", the judgement result of step 307 shown in FIG. 10B turns to "YES" at the next bar end timing so that the processing proceeds to step 312 wherein the flags SRF and RUN are both reset and the LED 29 is lighted off. When the rhythm run flag RUN is reset, both of steps 302 and 313 shown in FIG. 10 are not executed. Thus, the generation of rhythm tone and automatic performance tone is stopped.

Next, when the stop/continue switch 30 is operated again, the judgement result of step 406 turns to "YES" so that the processing proceeds to step 407 wherein the value of rhythm run flag RUN is set to "1" again and the LED 29 is lighted on. After this flag RUN is set, the rhythm tone and automatic performance tone are generated again. Herein, the address data ADR1, ADR2, read data RDD1, RDD2, read timing data RDTIM1, RDTIM2 are not changed at all after the preceding operation of switch 30 whereby the automatic performance is stopped. Therefore, when the value of flag RUN is set to "1" again, the musical tune is started to be performed from its preceding stop position.

As described above, the automatic performance is stopped when the switch 30 is operated in the automatic performance period, and this automatic performance is re-started when the switch 30 is operated again. Every time this switch 30 is operated, such operation is repeatedly executed. In order to play the automatic performance from its starting timing after the automatic performance is stopped, the start switch 28 must be operated.

Figure 14:
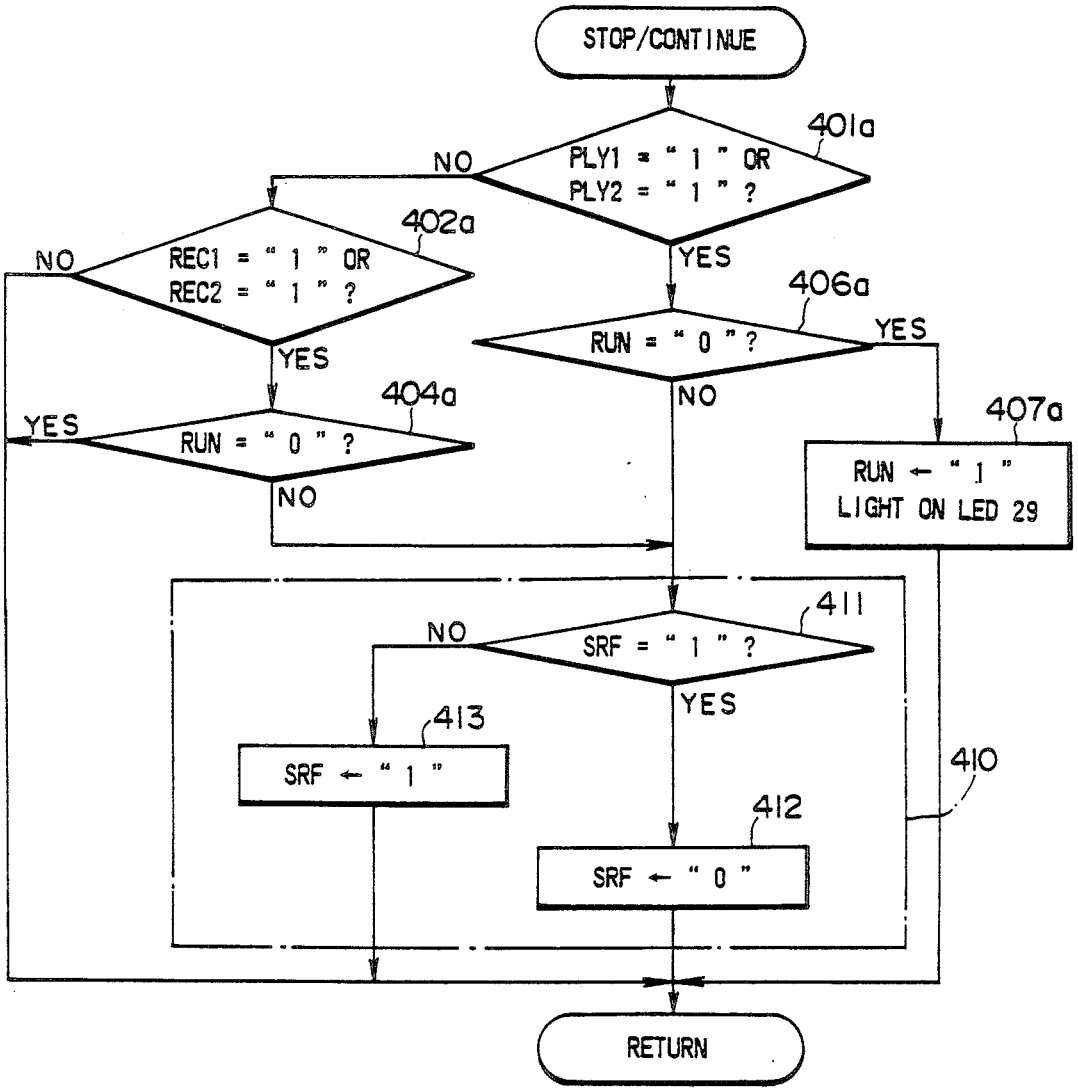
FIG. 14 is a flowchart showing another example of process shown in FIG. 11.

Above is the detailed description the first embodiment. Incidentally, instead of the stop/continue process shown in FIG. 11, it is possible to execute another stop/continue process as shown in FIG. 14. In FIG. 14, steps 401*a*, 402*a*, 404*a*, 406*a* and 407*a* are similar to steps 401, 402, 404, 406 and 407 shown in FIG. 11. However, instead of step 405 shown in FIG. 11, step 410 shown in FIG. 14 is used. In this step 410, step 411 is the step for judging whether the value of stop reserve flag SRF is equal to "1" or not. If the judgement result of this step 411 turns to "YES", the flag SRF is reset in step 412. On the other hand if this judgement result turns to "NO", the flag SRF is set in step 413. More specifically, since the stop/continue switch 30 is operated when the flag SRF takes the value "0", the process of step 410 is substantially similar to the process of step 405. However, the processes of FIG. 14 can cancel the stop command of automatic performance before the next bar end timing but after the operation of switch 30, which can not be executed by the processes of FIG. 11. More specifically, in the processes of FIG. 14, when the switch 30 is operated again, the processes of steps 411 and 412 are executed so that the value of stop reserve flag SRF is returned to "0", whereby it becomes possible to cancel the stop command of automatic performance.

[II] SECOND EMBODIMENT (A) Configuration of Second Embodiment

Figure 15:
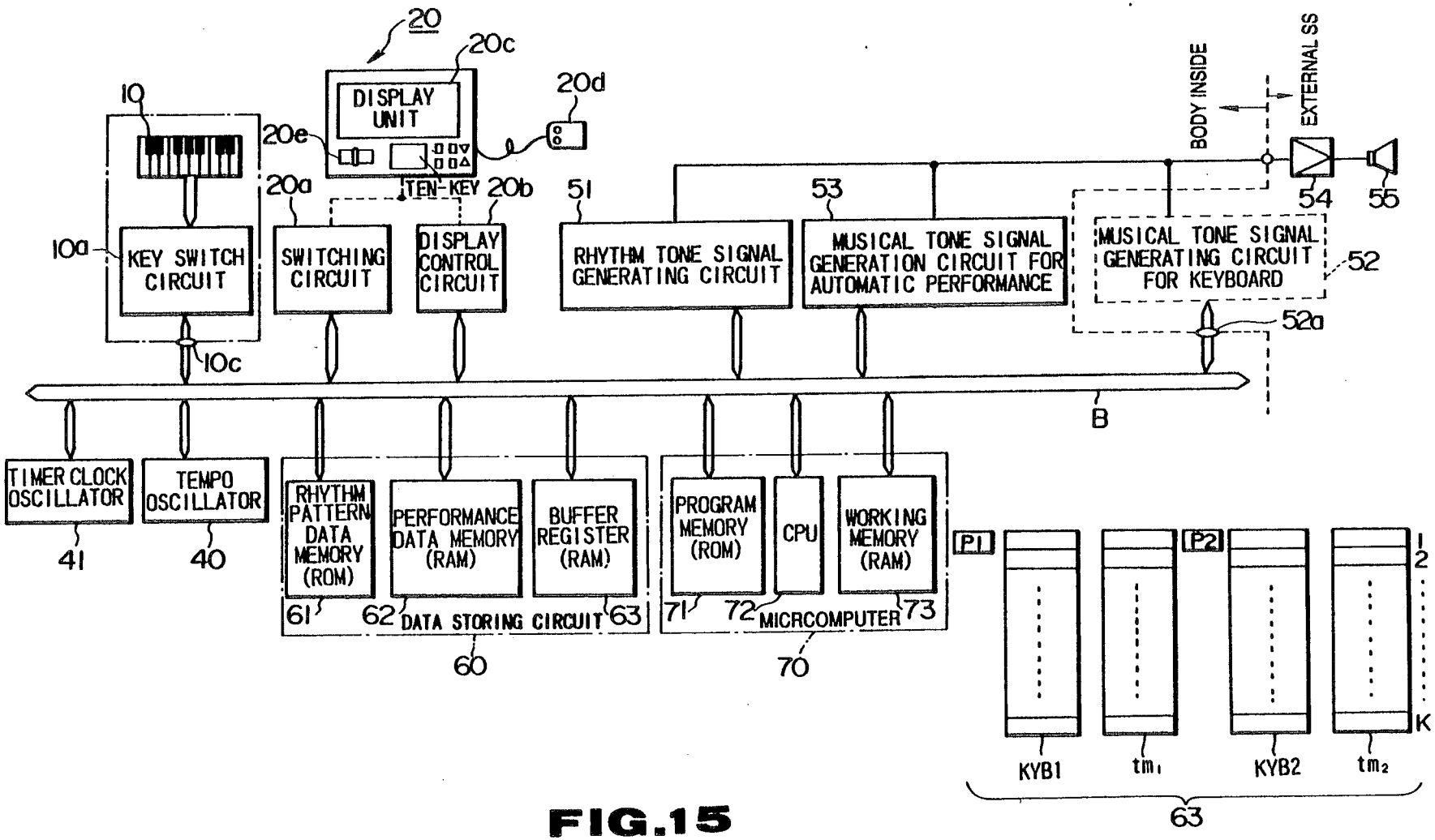
FIG. 15 is a block diagram showing a configuration of an electronic musical instrument employing an automatic performance apparatus according to a second embodiment of the present invention.

FIG. 15 is a block diagram showing the configuration of an electronic musical instrument employing an automatic performance apparatus according to a second embodiment of the present invention, wherein parts identical to those of FIG. 1 will be designated by the same numerals, hence, description thereof will be omitted.

In FIG. 15, the key touch detecting circuit 10*b* shown in FIG. 1 is omitted. And, the key switch circuit 10*a* detects the on/off state of each key within the keyboard 10 to thereby generate the key-depression information, which is then outputted to a bus B (corresponding to the bus 30 in FIG. 1) via a receiving terminal 10*c*.

The console panel 20 provides a display unit 20*c* and several switches 20*e* (such as ten-key, UP/DOWN key etc.), and this console panel 20 is also connected with a mouse-type device 20*d* (hereinafter, referred simply to the mouse 20*d*). The display unit 20*c* can display several data based on the display information which is inputted to the display control circuit 20*b* via the bus B.

In addition, a timer clock oscillator 41 generates a timer clock independent from the tempo clock generated from the tempo oscillator 40, and this timer clock is supplied to the microcomputer 70 as a timer interrupt signal. Hence, the CPU 72 executes the rhythm interrupt program (shown in FIG. 21) when the tempo clock from the tempo oscillator 40 is supplied thereto, while the CPU 72 executes a timer interrupt program (shown in FIG. 24) when the timer clock from the timer clock oscillator 41 is supplied thereto.

In the second embodiment, the automatic performance data whose data formats are as shown in FIG. 16 are used instead of the automatic performance data of first embodiment as shown in FIG. 4. The differences between the data formats of FIG. 16 and those of FIG. 4 are the key-depression data consisting of the identification mark and key code KC of depressed key and the key-release data consisting of the identification mark and key code KC of released key.

Further, the buffer register 63 is constituted by the RAM in which the following registers are preset.

(1) Key buffer register KYB1(P1), KYB2(P2)

In the automatic performance mode, the performance data read from the area I of performance data memory 62 are temporarily written in the key buffer register KYB(P1). After passing certain delay time, such performance data are read from the key buffer register KYB1(P1) and then outputted to the musical tone signal generating circuit 53. Similarly, the performance data read from the area II are temporarily written into the key buffer register KYB(P2). Each of these two key buffer registers KYB(P1) and KYB(P2) consists of k registers as shown in FIG. 15.

(2) Time measuring register tm1, tm2

These registers tm1 and tm2 are provided for measuring the above-mentioned delay time. The register tm1 corresponds to the key buffer register KYB(P1), while the register tm2 corresponds to the key buffer register KYB(P2). Each of these two registers tm1 and tm2 consists of k registers.

(3) Pointer registers P1, P2

These registers P1 and P2 are provided for respectively designating the key buffer registers KYB(P1) and KYB(P2).

(4) Timer registers TM1, TM2

The delay time of key buffer register KYB(P1) is set to the register TM1, while another delay time of key buffer register KYB(P2) is set to the register TM2.

(5) Source register FROM

In the case where the performance data of area I (or area II) are transferred and copied into another area II (or area I), a copy source area number is set to this register FROM.

(6) Copy register TO

In response to the above copy source area number, a copy destination area number is set to this register TO.

Incidentally, in addition to the data and flags to be temporarily stored in the working memory 73, a through flag THROU is used in the second embodiment. When this through flag THROU takes the value "1", the performance data to be transmitted via the receiving terminal 10*c* is outputted via a transmitting terminal 52*a*. On the other hand, when this flag THROU takes the value "0", the above transmission of the performance data is not made.

(B) Operation of Second Embodiment

Next, description will be given with respect to the operation of the second embodiment. In the second embodiment, several processes in the normal performance mode, data writing mode and automatic performance mode are similar to those of first embodiment, hence, description thereof will be omitted.

(1) Normal Performance Mode

Figure 17:
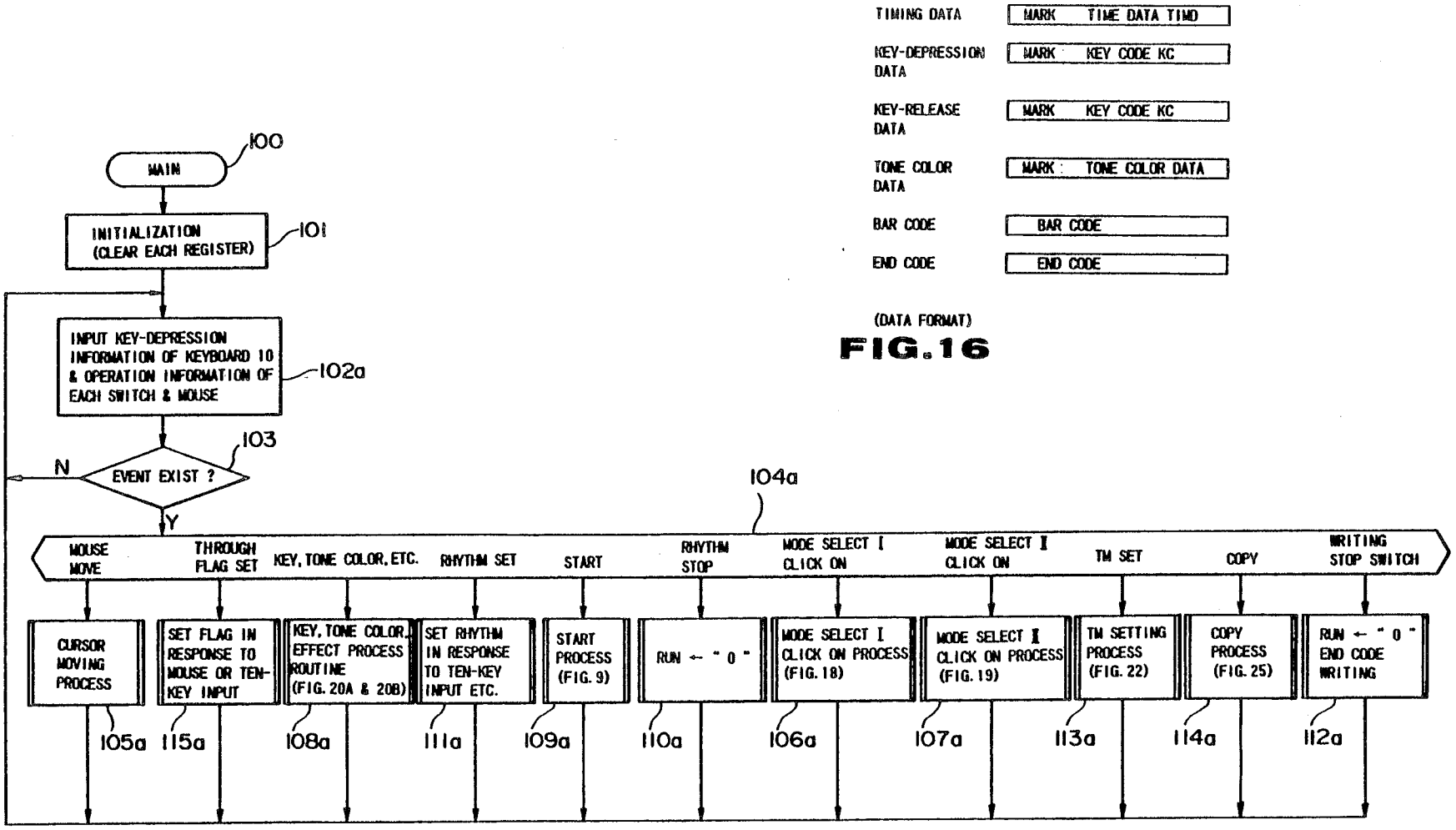
FIGS. 17 to 25 are flowcharts showing processes of the CPU 72 shown in FIG. 15.

Similar to the first embodiment, the electronic musical instrument shown in FIG. 15 functions as an electronic organ in this normal performance mode. In the second embodiment, the main routine program shown in FIG. 17 is executed. When the power switch (not shown) is operated, the CPU 72 initializes the buffer register 63 and working memory 73 in step 101. In next step 102*a*, the CPU 72 reads the key-depression and key-release information, operation information of switches and another operation information of mouse 20*d*, which are then written into the working memory 73 via the bus B. At this step, the key-depression and key-release information of the keyboard 10 is detected based on the output of the key switch circuit 10*a*, while the operation information of the switches of console panel 20 and the mouse 20*d* is detected based on the output of the switching circuit 20*a*. Next, the processing proceeds to step 103 wherein it is judged whether or not there exist the key-depression or key-release event of the keyboard 10, the operation event of the console panel 20 and the operation event of the mouse 20*d*.

When the judgement result of this step 103 is "NO", the processing returns to step 102*a*, whereby the CPU 72 repeatedly executes the circulating process consisting of steps 102*a* and 103.

In order to select the "normal performance mode", the mouse 20*d* is moved such that the cursor on the display screen of display unit 20*c* is moved to the position where the image "MODE SELECT I" is displayed, and then a click switch of mouse 20*d* is operated. When the mouse 20*d* is moved, the judgement result of step 103 shown in FIG. 17 turns to "YES" so that the processing proceeds to step 104*a* wherein the event kind is judged. This is the mouse moving event, so that the processing proceeds to step 105*a* (representing a cursor moving process) wherein the cursor to be displayed on the display unit 20c is moved, and then the processing returns to step 102. While the mouse 20d is moved, the processes of steps 102a to 105a are repeatedly executed. Next, when the click switch of mouse 20d is turned on in the state where the cursor is reached at the display position of "MODE SELECT I", the processing proceeds to step 106a (representing a mode select I click switch-on process) via step 104a.

Figure 18:
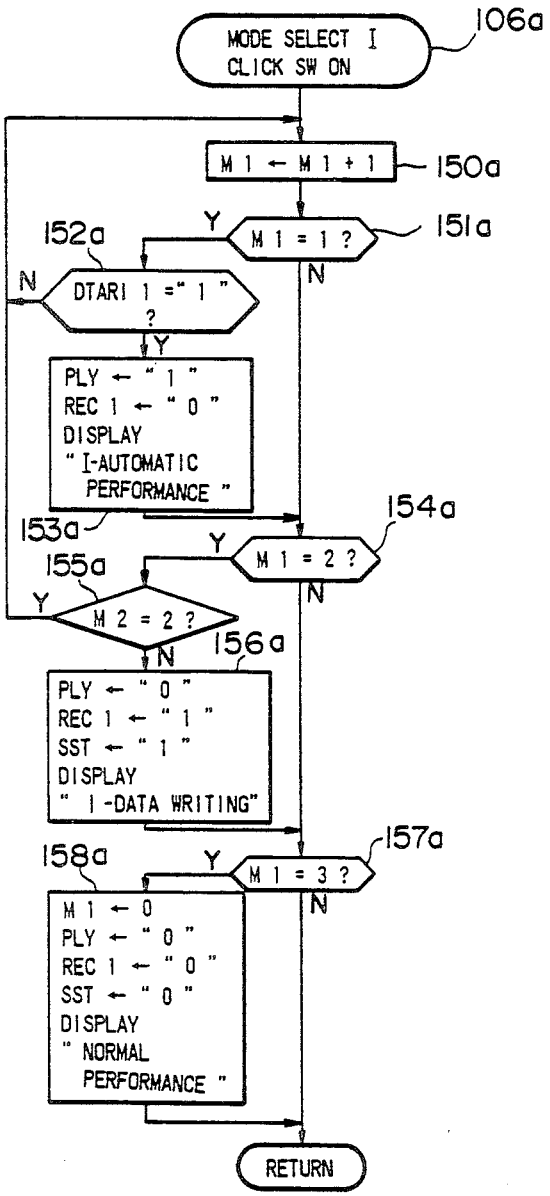

FIG. 18 is a flowchart showing the mode select I click switch-on process of the foregoing step 106a. In first step 150a, the mode data M1 is incremented. Next, it is judged whether or not the mode data M1 takes the value "1" in step 151a. When the judgement result of step 151a is "YES", the processing proceeds to step 152a. But, when this judgement result is "NO", the processing proceeds to step 154a. In step 152a, it is judged whether or not the record check flag DTARI1 takes the value "1". Then, the processing proceeds to step 153a when the judgement result of step 152a is "YES", while the processing returns to step 150a when it is "NO".

In step 153a, "1" is set to the play flag PLY1, while "0" is set to the record flag REC1. In addition, the mode display is made such that the display unit 20c displays the image "I-AUTOMATIC PERFORMANCE". In step 154a, it is judged whether or not the mode data M1 is at "2". Then, the processing proceeds step 155a when the judgement result of step 154a is "YES", while the processing proceeds to step 157a when it is "NO". In step 155a, it is judged whether or not the mode data M2 is at "2". Then, the processing returns to step 150a when the judgement result of this step 155a is "YES", while the processing proceeds to step 156a when it is "NO". In step 156a, "0" is set to the play flag PLY1, while "1" is set to both of the record flag REC1 and synchro-start flag SST. In addition, another mode display is made such that the display unit 20c displays the image "I-DATA WRITING". After executing the process of this step 156a, the processing proceeds to step 157a wherein it is judged whether or not the mode data M1 is at "3". Then, the processing returns to the foregoing step 102a when the judgment result of step 157a is "NO", while the processing proceeds to step 158a when it is "YES". In step 158a, "0" is set to the mode data M1, and the play flag PLY1, record flag REC1, synchro-start flag SST are respectively cleared. In addition, the display unit 20c displays the image "NORMAL PERFORMANCE".

As it is obvious from the above-mentioned processes, every time the click switch of the mouse 20d is depressed in the state where the cursor is set to the "MODE SELECT I", the mode data M1 is incremented (in step 150a). The, when the mode data M1 reaches "3", it is reset to "0" (see steps 157a and 158a). More specifically, every time the click switch is depressed, the mode data M1 sequentially varies as 0, 1, 2, 0, 1, 2, . . . In response to the value of mode data M1, the CPU 72 sets the flags and makes the mode display (see steps 153a, 156a and 158a), by which the operation mode is determined.

Incidentally, in the case where the performance data has not been written in the area I within the memory 62 yet while the mode data M1 is at "1" (i.e., automatic performance mode is set), the judgement result of step 152a turns to "NO". Then, the processing returns to step 150a so that the mode data M1 turns to "2". In other words, when the performance data is not written into the area I, the value of mode data M1 directly jumps to "2" from "0". Therefore in this case, it is impossible to set "1" to the mode data M1. On the other hand in the case where the mode data M1 is at "2" (i.e., the data writing mode) while the mode data M2 has been already at "2", judgement result of step 155a turns to "YES" so that the processing proceeds to step 150a wherein the mode data M1 is incremented again. Therefore, when the mode data M2 is at "2", it is impossible to set "2" to the mode data M1. This prevents the areas I and II from being written by the same data.

Figure 19:
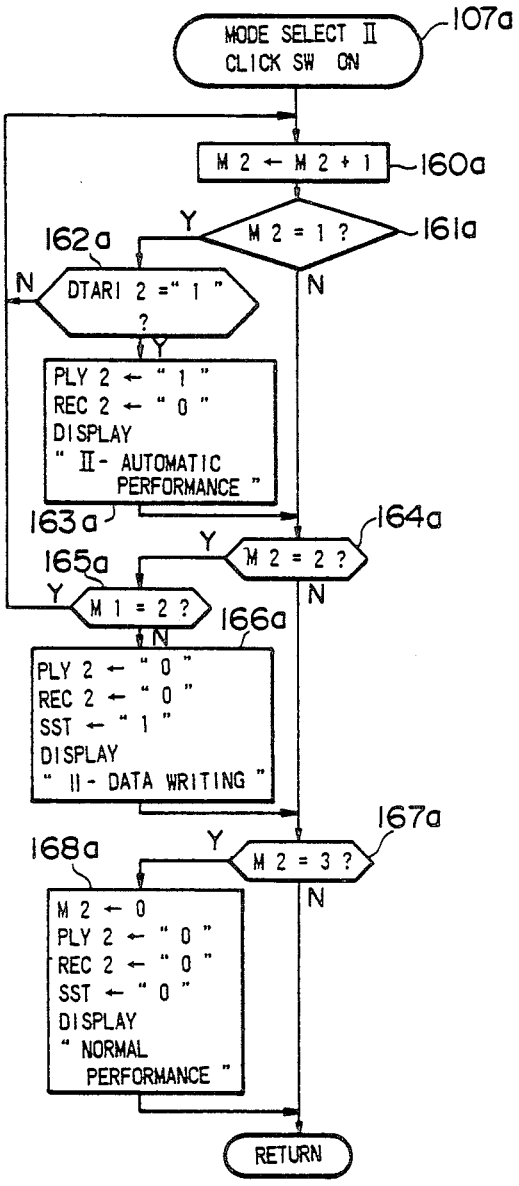

Next, when the click switch is turned on in the state where the cursor is positioned at the display position of "MODE SELECT II", the processing proceeds to step 107a (representing a mode select II click switch on process as shown in FIG. 19) via step 104a shown in FIG. 17. However, the processes of FIG. 19 are identical to those of FIG. 18, hence, description thereof will be omitted. It is noted that M1 in FIG. 18 is rewritten by M2 in FIG. 19.

In the meantime, when the normal performance mode is set to both of MODE SELECT I & II by using the mouse 20d, "0" is set to all of the play flags PLY1, PLY2 and record flags REC1, REC2 (see step 158a in FIG. 18 and step 168a in FIG. 19). Next, the player sets the through flag THROU. In the present electronic musical instrument, when the through flag THROU is at "1", the performance data received at the terminal 10c is outputted to the musical tone signal generating circuit for keyboard 52 via the terminal 52a. so that the keyboard musical tone is to be generated. In contrast, when THROU is at "0", the performance data at the terminal 10c is prevented from being outputted to the musical tone signal generating circuit 52. Therefore, prior to the performance, the through flag THROU should be set.

In order to set this through flag THROU, the player positions the cursor at "THROUGH FLAG SETTING" on the display unit 20c by the mouse 20d. Thus, the processing of the CPU 72 proceeds to step 115a in FIG. 17. In this state, when the player inputs "1" or "0" by the mouse 20d or the ten-key in the console panel 20, the CPU 72 sets such inputted data within the working memory 73. In this case, it would be provisionally judged that the player inputs "1".

Next, when the player uses the keyboard 10 to play the performance, the corresponding musical tones are to be generated from the speaker 55.

More specifically, when any one of the keys within the keyboard 10 is on, the judgement result of step 103 in FIG. 17 turns to "YES" so that the processing proceeds to step 108a of the key, tone color, effect process routine via step 104a.

Figure 20A:
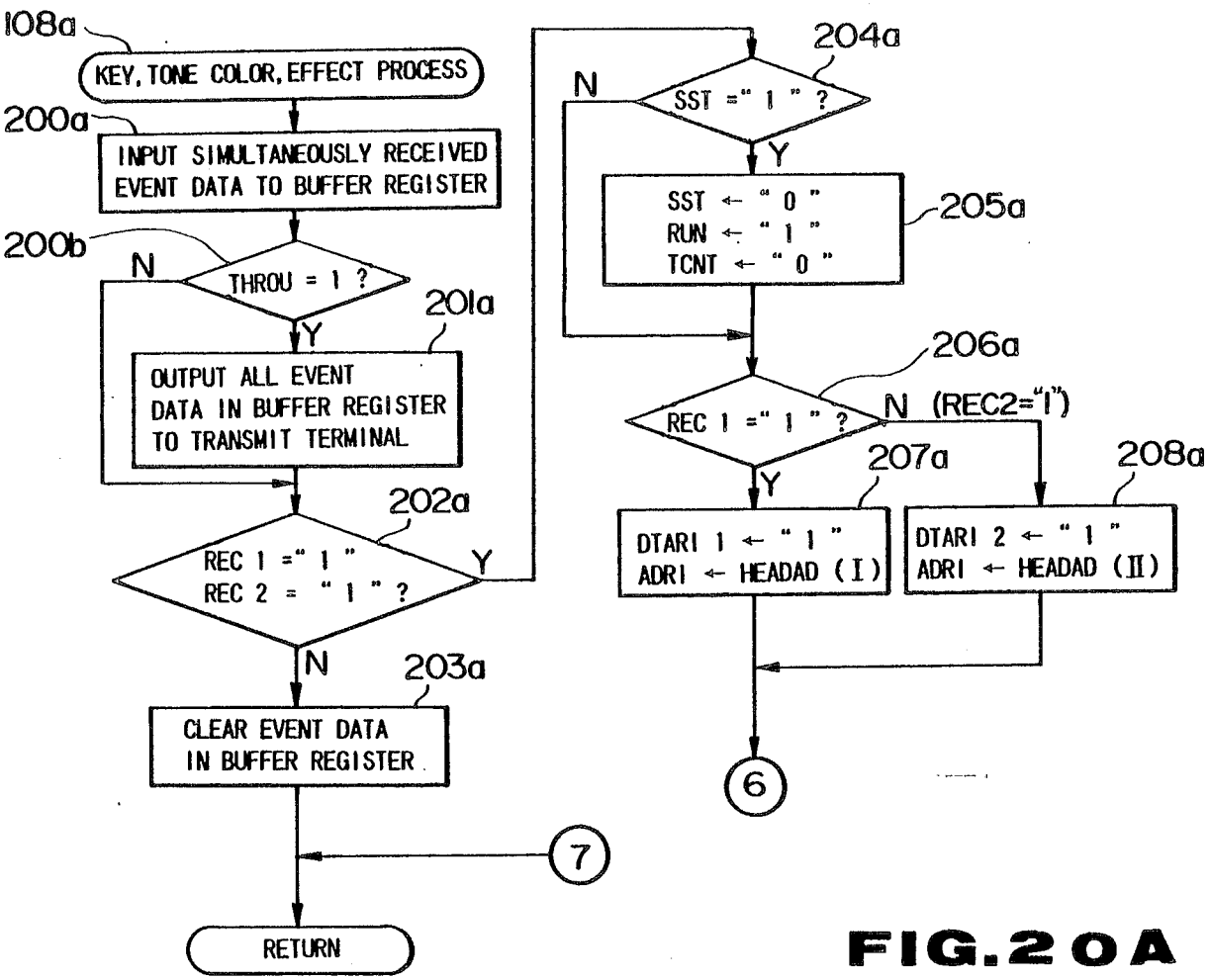
Figure 20B:
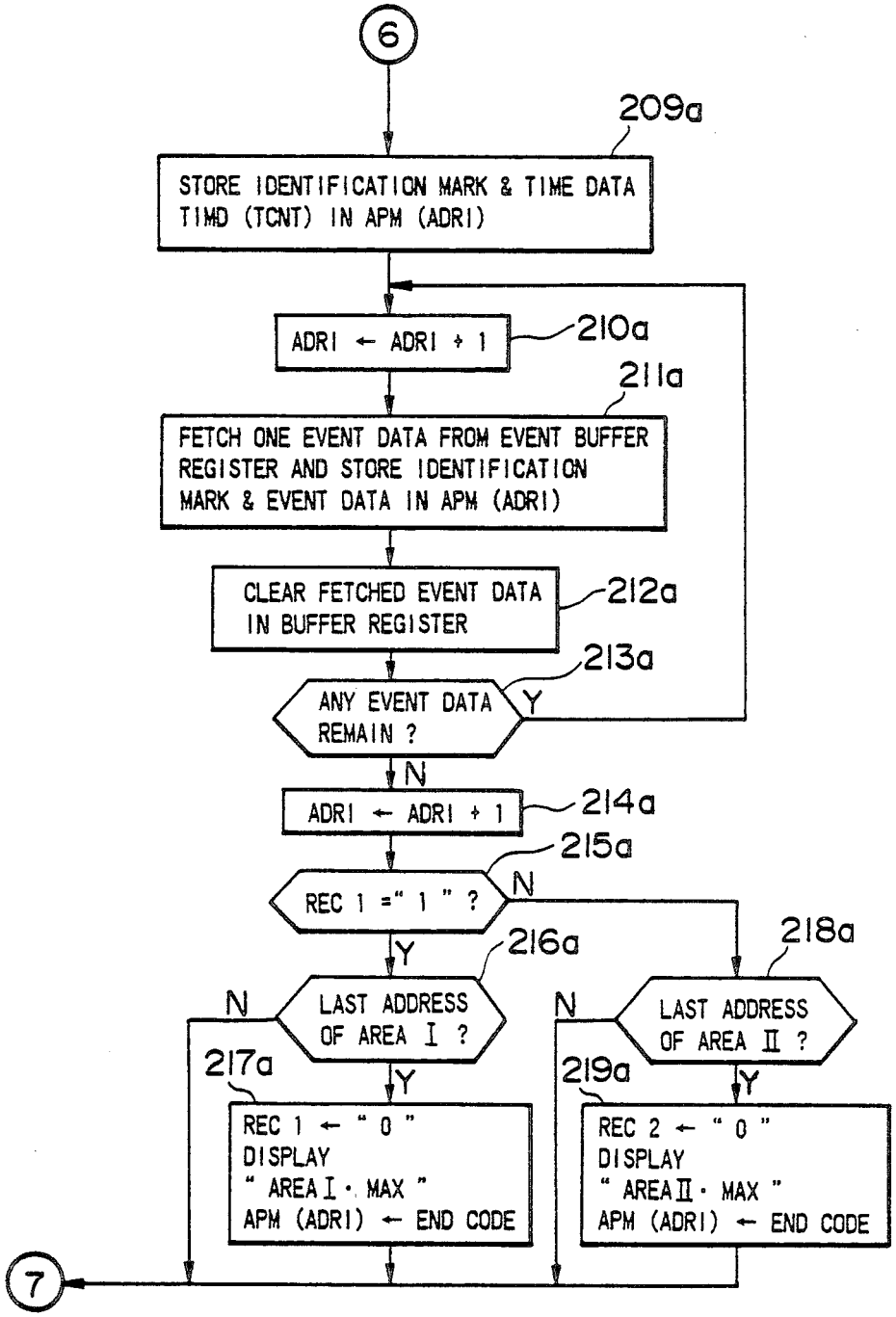

FIGS. 20A and 20B, i.e., the key, tone color, effect process routine in a step 108a correspond to FIGS. 8A and 8B in the foregoing first embodiment.

In first step 200a of FIG. 20A, the buffer register 63 inputs the event data which are simultaneously received via the terminal 10c. In this case, the key-depression data consisting of the identification mark and the key code KC of the depressed key (see FIG. 16) is inputted to the buffer register 63. Next, the processing proceeds to step 200b wherein it is judged whether or not THROU is at "1". When the judgment result of this step 200b is "YES", the processing proceeds to step 201a wherein all of the event data written in the buffer register 63 are outputted to the terminal 52a. Thus, the musical tone signal generating circuit 52 forms the musical tone signal corresponding to the depressed key, and this musical tone signal is then supplied to the speaker 55. On the other hand, when the through flag THROU is at "0" so that the judgement result of step 200b is "NO". the processing jumps over step 201a and directly proceeds to step 202a. As described heretofore, the event data is transmitted to the musical tone signal generating circuit 52 via the terminal 52a when THROU is at "1", while the event data is not transmitted to the circuit 52 when THROU is at "0".

In step 202a, it is judged whether or not the record flag REC1 or REC2 is at "1". In this case, the judgement result of step 202a is "NO", so that the processing proceeds to step 203a wherein the event data in the buffer register 63 is cleared. Thereafter, the processing returns to step 102a of FIG. 17.

Next, when the depressed key within the keyboard 10 is released, the processing proceeds to step 200a (in FIG. 20A) from step 103 via step 104a as similar to the case of key-depression event. Thus, the key-release data consisting of the identification mark and key code KC of the released key is inputted into the buffer register 63. Then, such key-release data is outputted to the musical tone signal generating circuit 52 in step 201a, so that the generation of the musical tone corresponding to the released key is terminated. Next, the processing returns to step 102a (in FIG. 17) via steps 202a and 203a.

Next, when the desirable tone color is selected by the mouse 20d or switches 20e, the event data indicative of the selected tone color is written into the buffer register 63 in step 200a. In next step 201a, such event data is outputted to the musical tone signal generating circuit 52. Thus, the selected tone color is set within this circuit 52. Similar to this case wherein the desirable tone color is set, the desirable musical effect will be set.

Next, in order to generate the rhythm tone, the player should depress the start switch in the console panel 20. When this start switch is depressed, the judgment result of step 103 turns to "YES" so that the processing proceeds to step 109a of start process routine via step 104a. This routine is identical to that of FIG. 9 of the first embodiment, hence, description thereof will be omitted.

When the start switch is depressed in the normal performance mode "1" is set to the rhythm run flag RUN and the tempo count data TCNT is cleared. After "1" is set to RUN, the rhythm tone is generated based on the tempo clock outputted from the tempo oscillator 40.

Figure 21:
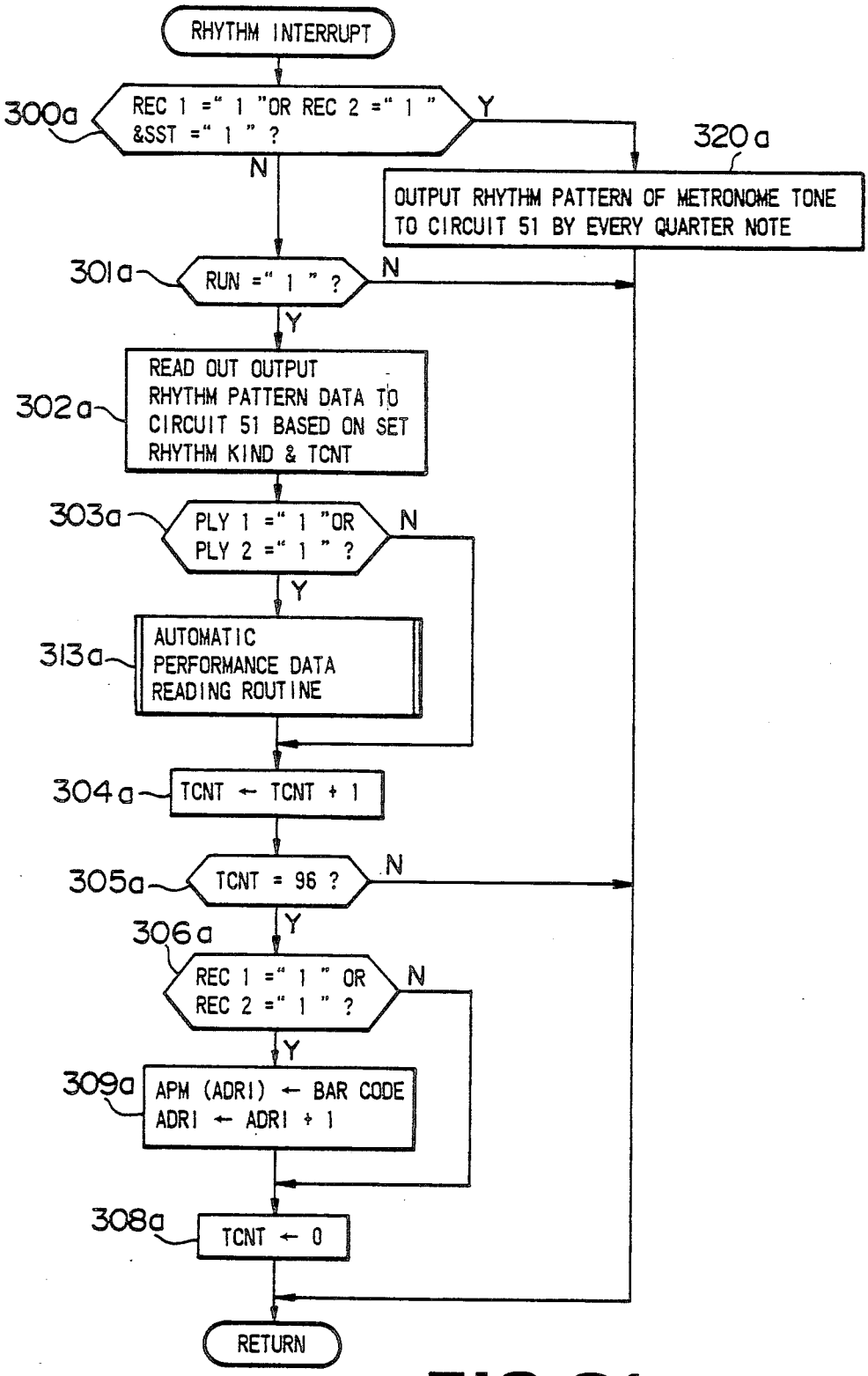

More specifically, when the tempo oscillator 40 outputs the tempo clock, the CPU 72 is interrupted so that the processing proceeds to the rhythm interrupt process routine of FIG. 21 (corresponding to that of FIGS. 10A and 10B of the first embodiment). In first step 300a of FIG. 21, it is judged whether or not the record flag REC1 or REC2 is at "1" and the synchro-start flag SST is at "1". If the judgement result of step 300a is "NO", the processing proceeds to step 301a wherein it is judged whether or not the rhythm run flag RUN is at "1". Then, the processing returns to the main routine of FIG. 17 when the judgement result of step 301a is "NO", while the processing proceeds to step 302a when it is "YES". In step 302a, the rhythm patter data is read from the memory 61 based on the data indicative of the rhythm kind and the tempo count data TCNT. Then, the read rhythm pattern data is outputted to the rhythm tone signal generating circuit 51. This rhythm pattern data drives each percussive musical tone signal generating circuit within the rhythm tone signal generating circuit 51, so that the rhythm tone is generated.

Next, it is judged whether or not the play flag PLY1 or PLY2 is at "1" in step 303a. In this case, the judgement result of step 303a is "NO", so that the processing proceeds to step 304a wherein the tempo count data TNCT is incremented. In next step 305a, it is judged whether or not the tempo count data TCNT is at "96" indicative of the bar end. In this case, the judgement result of step 305a is "NO", so that the processing returns to the main routine of FIG. 17.

Afterwards, every time the tempo clock is generated, the rhythm tone is generated in the foregoing step 302a, and the tempo count data TCNT is incremented in the foregoing step 304a. When the tempo count data TCNT reaches "96", the judgement result of step 305a turns to "YES" so that the processing proceeds to step 306a wherein it is judged whether or not the record flag REC1 or REC2 is at "1". In this case, the judgement result of step 306a is "NO" so that the processing proceeds to step 308a wherein the tempo count data TCNT is cleared. Thereafter, the processing returns to the main routine.

The above is the description of the rhythm tone generating process. In order to stop generating the rhythm tone in the normal performance mode, the player should depress the rhythm stop switch in the console panel 20. When this stop switch is depressed, the processing proceeds to step 110a (see FIG. 17) from step 103 via step 104a. In this step 110a, the rhythm run flag RUN is reset to "0". Thus, the judgement result of step 301a of FIG. 21 is "NO" afterwards, so that the generation of rhythm tone is terminated.

In order to change the rhythm in the middle of the performance, the player positions the cursor at "RHYTHM SETTING" by the mouse 20d. Thus, the processing of the CPU 72 proceeds to step 111a from step 103 via step 104a. In this step 111a, the display unit 20c displays the rhythm kinds to be selected. Then, the player selects desirable one of the displayed rhythm kinds by operating the ten-key, UP/DOWN key or the mouse 20d. The data indicative of the selected rhythm kind is set within the working memory 73. Afterwards, based on this set data, the rhythm pattern data is read from the memory 61.

(2) Data Writing Mode

The processes of this data writing mode of the second embodiment are similar to those of the first embodiment, hence, description thereof will be omitted.

(3) Automatic Performance Mode

Similar to the automatic performance mode of the first embodiment, the performance data memory 62 provides two areas I and II in which the performance data of two tunes or two parts can be recorded. In this case, it is possible to play the automatic performance of one tune (or one part) only and it is also possible to simultaneously play the automatic performance of two tunes (or two parts). More specifically, when "1" is set to M1, "0" is set to M2 and the start switch is depressed, the present embodiment plays the automatic performance based on the performance data of area I only (hereinafter, referred simply to "automatic performance I"). On the other hand, when "0" is set to M1, "1" is set to M2 and the start switch is depressed, the present embodiment plays the automatic performance based on the performance data of area II only (hereinafter, referred simply to "automatic performance II"). Further, when "1" is set to both of M1 and M2, the present embodiment plays the automatic performance based on both of the performance data of areas I and II, in other words, the automatic performances I and II are simultaneously played.

Hereinafter, description will be given with respect to the case where "1" is set to both of M1 and M2. Incidentally, it is assumed that the performance data have been already written in the areas I and II (i.e., DTARI1="1", DTARI2="1").

Figure 22:
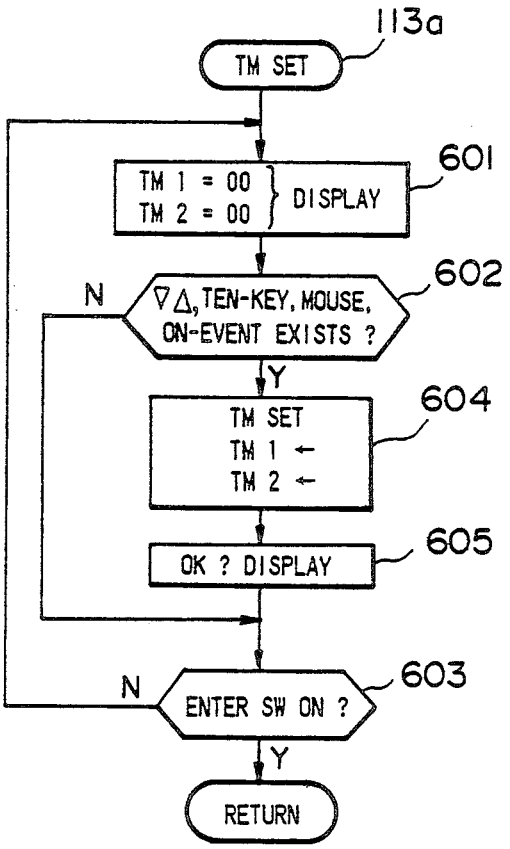

This electronic musical instrument can provide a deviation (or time difference) between the tone-generation timing of automatic performance I and another tone-generation timing of automatic performance II. In order to simultaneously play the automatic performances I and II, the player should first set the tone-generation timing. More specifically, the cursor is positioned at "TM(Timer) SETTING" by the mouse 20*d*. Thus, the processing of the CPU 72 proceeds to step 113*a* of FIG. 17. FIG. 22 is a flowchart showing the TM setting process routine of step 113*a*. In first step 601 of FIG. 22, the display unit 20*c* displays the image of "TM1=00, TM2=00". Herein, TM1, TM2 indicate the tone-generation timings of the automatic performances I, II. More specifically, TM1, TM2 designate the respective periods (sec) between the first time when the star switch is depressed and the second time when the automatic performances I, II are respectively played. In next step 602, it is judged whether or not the ten-key, UP/DOWN key of the console panel 20 or the mouse 20*d* is operated. When the judgement result of step 602 is "NO", the processing proceeds to step 603 wherein it is judged whether or not the ENTER switch in the console panel 20 is on. When the judgement result of step 603 is "NO", the processing returns to step 601. Thus, thereafter the processes of steps 601 to 603 are repeatedly executed.

Next, when the player inputs the tone-generation timings TM1, TM2 of the automatic performances I, II by the ten-key, UP/DOWN key or the mouse 20*d*, the judgement result of step 602 turns to "YES" so that the processing proceeds to step 604 wherein such inputted tone-generation timings are respectively set to the timer registers TM1, TM2. In next step 605, the display unit 20*c* displays the image "OK?", which means "Do you accept the set tone-generation timing?". Then, the processing returns to step 601 via step 603, whereby the values set in the timer registers TM1, TM2 are displayed on the display unit 20*c*. Thereafter, the processes of steps 602, 603, 601 are repeatedly executed.

In order to change the displayed tone-generation timings, the player can input the new tone-generation timings by the UP/DOWN key etc. If the player satisfies with the displayed tone-generation timings, the player should turn on the ENTER switch. Thus, the judgement result of step 603 turns to "YES", so that the processing returns to the main routine of FIG. 17. This is the description of the process of setting the tone-generation timings.

After completing the process of setting the tone-generation timings, "1" is set to both of M1, M2 by the mouse 20*d*, and then the start switch is depressed. When "1" is set to the mode data M1, M2, the process of step 153*a* of FIG. 18 and the process of step 163*a* of FIG. 19 are respectively executed. Due to these processes, the play flags PLY1, PLY2 are both set at "1", the record flags REC1, REC2 are both set at "0", and the display unit 20*c* displays the images of "I-AUTOMATIC PERFORMANCE", "II-AUTOMATIC PERFORMANCE".

Next, when the start switch is depressed, the processing proceeds to the foregoing routine of FIG. 9 whose processes have been already described in the first embodiment, hence, description thereof will be omitted.

The above-mentioned processes are made at the preparation stage of the automatic performances I, II. After such preparation is completed, based on the tempo clock from the tempo oscillator 40 and timer clock from the timer clock oscillator 41, the automatic performances I, II are made, and the automatic rhythm tone is also generated. In this case, the timer clock is used to measure the tone-generation timing (i.e., the delay time) described above.

Figure 23A:
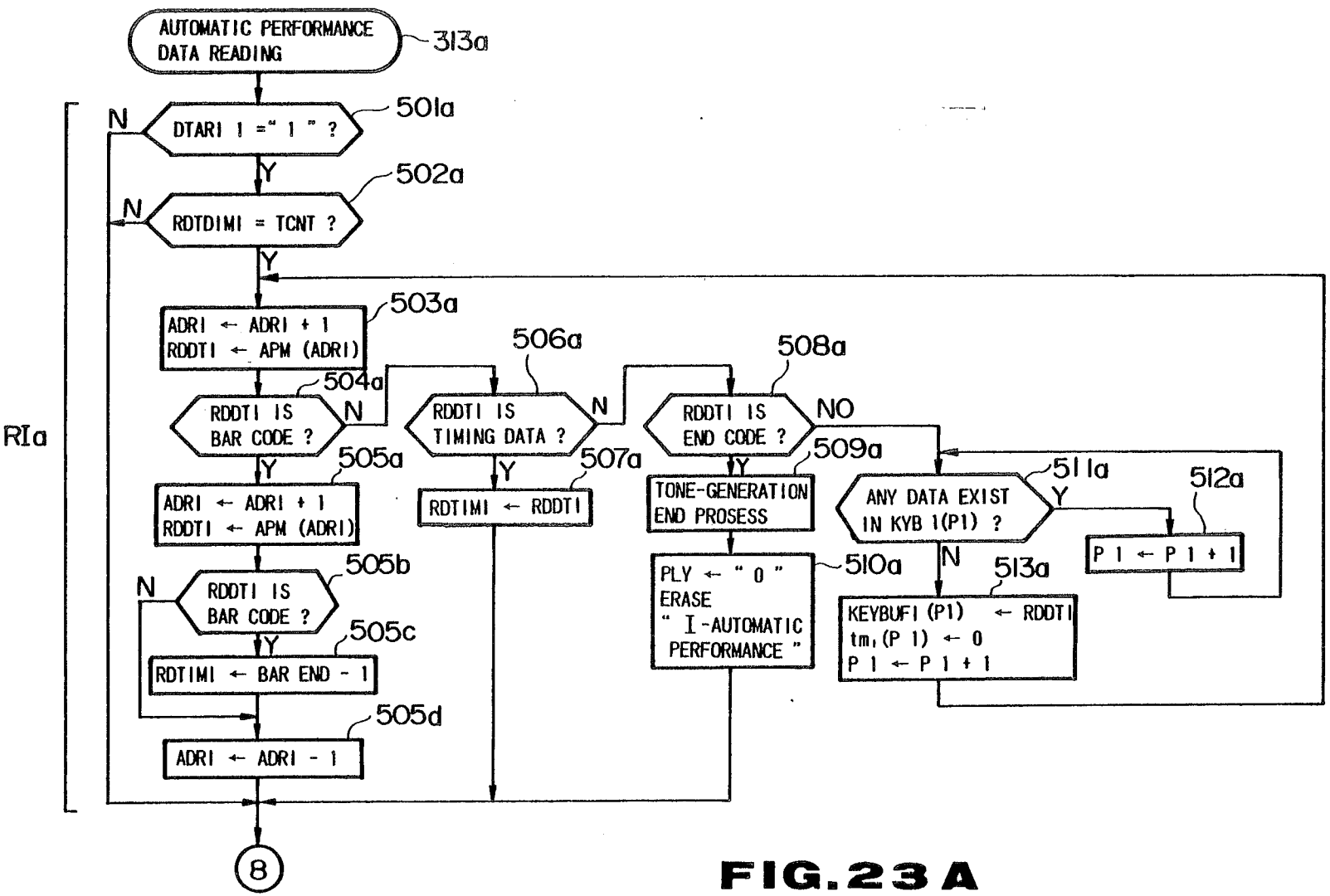
Figure 23B:
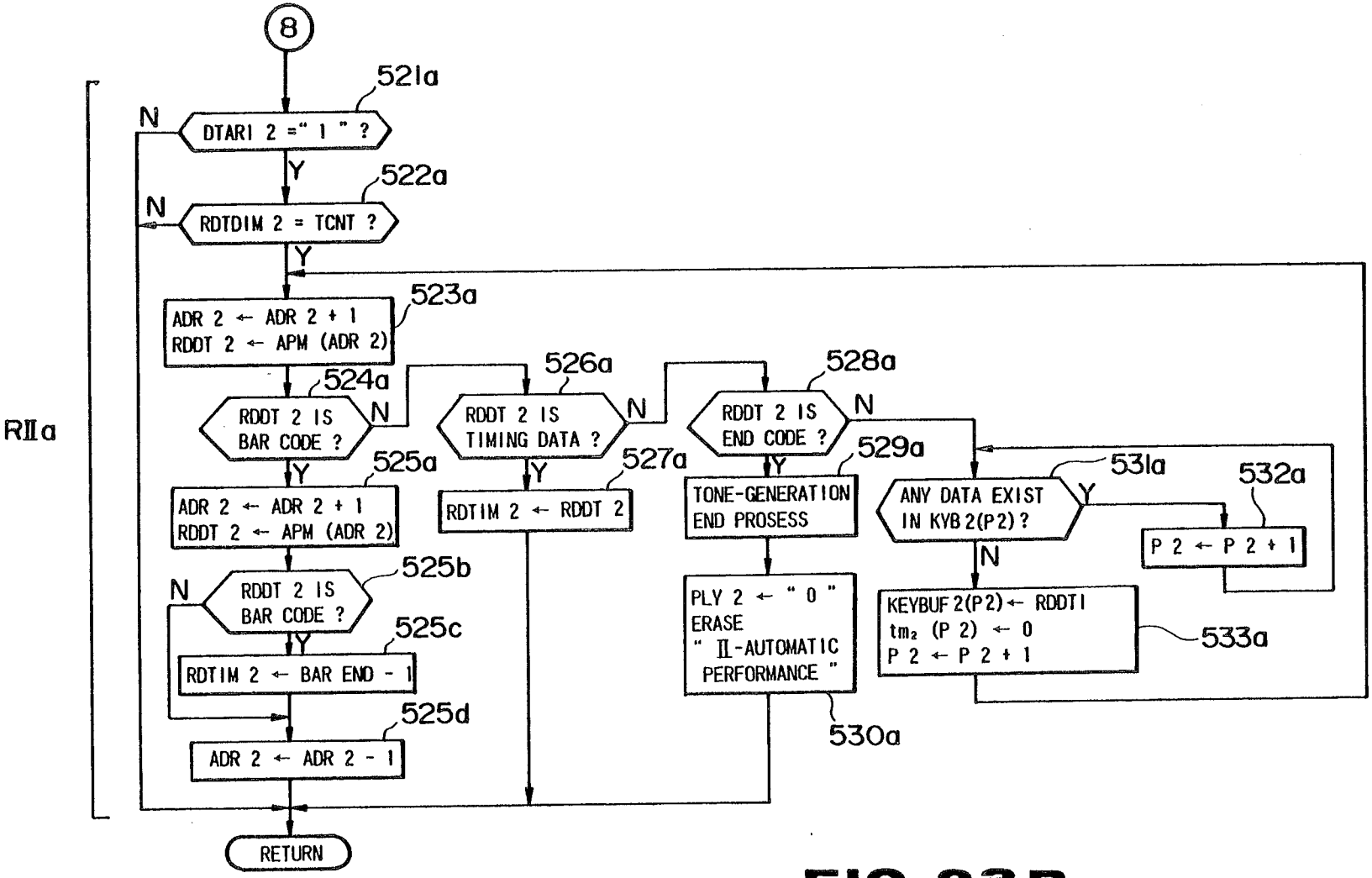

Next, detailed description will be given with respect to the automatic performance process. When the tempo clock is generated, the CPU 72 is interrupted, so that the processing enters into the rhythm interrupt process of FIG. 21. In this case, the processing passes through steps 300*a* and 301*a* and then proceeds to step 302*a* wherein the rhythm tone is generated. Next, the judgement result of step 303*a* turns to "YES", so that the processing proceeds to an automatic performance data reading routine of step 313*a*. FIGS. 23A and 23B are flowcharts showing the detailed processes in this routine of step 313*a*. This routine consists of a routine RIa for reading the performance data from the area I of the memory 62 and another routine RIIa for reading the performance data from the area II. In these routines, the processes of routine RIa are identical to those of routine RIIa, however, the da&a and flags to be used are different in these two routines.

In first step 501*a* of FIG. 23A, it is judged whether or not the record check flag DTARI1 is at "1". When the judgement result of step 501*a* is "NO", i.e., when the performance data is not written in the area I, the processing jumps over the routine RIa and then proceeds to the next routine RIIa. On the other hand, when the judgement result of step 501*a* is "YES", the processing proceeds to step 502*a* wherein it is judged whether or not the tempo count data TCNT is equal to the read timing data RDTIM1. Then, the processing leaves the routine RIa and enters into the routine RIIa when the judgement result of step 502*a* is "NO", while the processing proceeds to step 503*a* when it is "YES". In step 503*a*, the address data ADR1 is incremented. In addition, the data is read from the storing position APM(ADR1) of the memory 62 and then set as the read data RDDT1. In next step 504*a*, it is judged whether or not the read data RDDT1 designates the bar mode. When the judgement result of step 504*a* is "YES", the processing proceeds to step 505*a*. In steps 505*a* and 505*b*, the processes similar to those of steps 503*a* and 504*a* are executed so that it is judged whether or not the data read from the storing position APM(ADR1) designates the bar code. Then, the processing proceeds to step 505*c* when the judgement result of step 505*b* is "YES", while the processing proceeds to step 505*d* when it is "NO". In step 505*c*, the value "95" which is obtained by subtracting "1" from the bar end value "96" is set as the read timing data RDTIM1, and then the processing proceeds to step 505*d*. In step 505*d*, the address data ADR1 is decremented, by which the present state is returned back to the state of step 503*a*.

Meanwhile, when the judgement result of step 504*a* is "NO", the processing proceeds to step 506*a* wherein it is judged whether or not the read data RDDT1 is the timing data. When the judgement result of this step 506*a* is "YES", the processing proceeds to step 507*a* wherein the read data RDDT1 is set as the read timing data RDTIM1. On the other hand, when the judgement result of step 506a is "NO", the processing proceeds to step 508a wherein it is judged whether or not the read data RDDT1 designates the end code. When the judgement result of step 508a is "YES", the processing proceeds to step 509a wherein the tone-generation end process is executed. More specifically, the key-release data for terminating the tone-generation is outputted to the musical tone signal generating circuit 53. This terminates the generation of musical tone. Next, in step 510a, the play flag PLY1 is cleared and the image "I-AUTOMATIC PERFORMANCE" on the display unit 20c is erased. In addition, the rhythm run flag RUN is reset. After executing the process of step 510a, the processing leaves the routine RIa.

In the case where the judgement result of step 508a is "NO", the processing proceeds to step 511a wherein it is judged whether or not the performance data has been already written into the key buffer register KYB1(P1) which is designated by the data in the pointer register P1. When the judgement result of step 511a is "YES", the processing proceeds to step 512a wherein the data in the pointer register P1 is incremented. After executing the process of step 511a, the processing returns to step 511a again. In this case, if the value of data in the pointer register P1 becomes equal to "K+1" (where K indicates the whole number of the key buffer registers KYB1), it is returned to "1". Next, when the judgement result of step 511a turns to "NO", the processing proceeds to step 513a wherein the read data RDDT1 is written into the key buffer KYB1(P1) designated by the pointer register P1; the time measuring register tm1(P1) designated by the pointer register P1 is cleared; and the data in the pointer register P1 is incremented. As described above, when the data in the pointer register P1 reaches "K+1", it is returned to "1", and then the processing returns to step 503a.

As described heretofore, when the processing enters into the automatic performance data reading routine (see step 313a), it proceeds to step 502 via step 501. If the judgement result of step 502 is "NO", the processing leaves this routine RIa. In other words, until the tempo count data TCNT becomes equal to the read timing data RDTIM1, the tone-generation process should not been executed at all. Next, when TCNT becomes equal to RDTIM1, the next performance data is read from the area I (in step 503a). For example, in the case where this performance data relates to the key-off event, the CPU 72 searches the vacant registers among the K key buffer registers KYB1 (in steps 511a and 512a). Then, in step 513a, the performance data is written into the vacant key buffer register KYB1(P1); and the time measuring register tm1(P1) corresponding to the register KYB1(P1) is cleared. Next, the processing returns to step 503a, whereby the reading operation is performed again. When the read data is the timing data, the process of step 507a is executed. Thereafter, until the tempo count data TCNT becomes equal to the read timing data RDTIM1 which is set in step 507a, the tone-generation process is not executed. When TCNT and RDTIM1 becomes equal to each other, the above-mentioned processes are executed again.

In the meantime, if the data read from the area I designates the bar code, it is judged whether or not the data written in the address next to the address where the bar code is stored also designates the bar code (in steps 505a and 505b). If this data designates the bar code (i.e., if the bar codes are stored in the continuous two addresses), the value of read timing data RDTIM1 is set at "95". As a result, the tone-generation process is not executed until the next bar end timing. At the next bar end timing, the CPU 72 begins to read the data from the area I. Incidentally, if the data read from the area I designates the end code, the processes of steps 509a and 510a are executed so that the automatic performance I is terminated.

The above is the processes of the routine RIa. In this routine RIa, every time the performance data concerning the key-depression, key-release and tone color except for the special data (such as the bar code, timing data, end code) is read from the area I, the performance data are sequentially written into the key buffer register KYB1(P1), and the time measuring register tm1(P1) corresponding to this register KYB1(P1) is initialized. When the time set in the timer register TM1 passes by after the performance data is written in the key buffer register KYB1(P1), this performance data is outputted to the musical tone signal generating circuit 53, thus the musical tones of the automatic performance I are generated. Hereinafter, description will be given with respect to this process.

Figure 24:
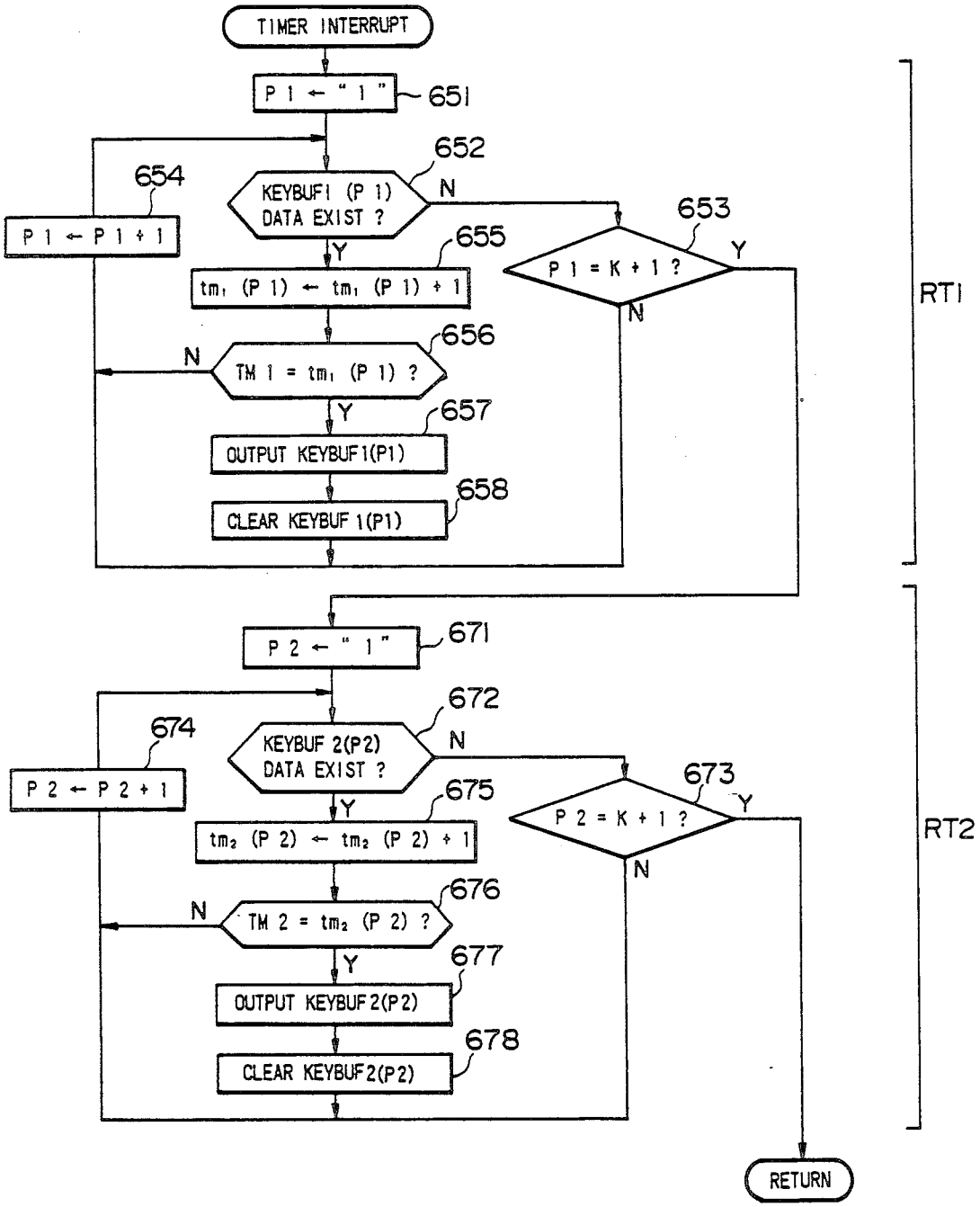

When the timer clock oscillator 41 outputs the timer clock, the CPU 72 is interrupted so that the processing of the CPU 72 enters into a timer interrupt process as shown in FIG. 24. This timer interrupt process consists of a routine RT1 for processing the performance data in the register KYB1(P1) and another routine RT2 for processing the performance data in the register KYB2(P2). The contents of the processes of these two routines RT1 and RT2 are substantially the same, while the registers KYB1(P1), KYB2(P2) are different, hence, description of the routine RT2 will be omitted.

In first step 651 of the routine RT1, "1" is set to the pointer register P1. In next step 652, it is judged whether or not the performance data is written in the key buffer register KYB1(P1). When the judgement result of step 652 is "NO", the processing proceeds to step 653 wherein it is judged whether or not the data in the pointer register P1 indicates the value "K+1" (i.e., whether or not the processes for all K key buffer registers KYB1 are completed). When the judgement result of step 653 is "NO", the processing proceeds to step 654 wherein the data in the pointer register P1 is incremented. Then, the processing returns to step 652 wherein it is judged whether or not the performance data is written in the next key buffer register KYB(P1). If the judgement result of step 652 is "YES", the processing proceeds to step 655 wherein the data in the time measuring register tm1(P1) corresponding to the register KYB(P1) is incremented. Next, in step 656, it is judged whether or not the data in the time measuring register tm1(P1) is identical to the data (indicative of the delay time) in the timer register TM1. When the judgement result of step 656 is "NO", the process of step 654 is executed and then &he processing returns to step 652. On the other hand, when the judgement result of step 656 is "YES", the processing proceeds to step 657 wherein the performance data in the key buffer register KYB(P1) is outputted to the musical tone signal generating circuit 53. Thus, the musical tones for the automatic performance are generated, only when the performance data designates the key-depression data indicative of the key-on event. In next step 658, the key buffer register KYB(P1) is cleared. Then, after executing the process of step 654, the processing returns to step 652.

Thereafter, the above-mentioned processes are repeated. When the data value of pointer register P1 reaches "K+1", the judgement result of step 653 turns to "YES", thus the processing leaves from the routine RT1 and then enters into the routine RT2. As described above, the routine RT1 delays the performance data in the key buffer register KYB1 by the delay time indicated by the data in the timer register TM1, and then this delayed performance data is outputted to the musical tone signal generating circuit 53, whereby the automatic performance I is made.

As described heretofore, in the electronic musical instrument as shown in FIG. 15, when the performance data are sequentially read from the areas I and II of the memory 62, the performance data are respectively written into the key buffer registers KYB1(P1) and KYB2(P2). Then, when the delay times set in the timer registers TM1, TM2 are passed after the performance data are written in the key buffer registers (i.e., after the performance data are read from the memory 62), these written performance data are read out and then supplied to the musical tone signal generating circuit 53. Therefore, the second embodiment can play the automatic performances I and II with the arbitrary time difference.

(4) Copy Function

The present electronic musical instrument according to the second embodiment can copy the performance data in the area I to the area II, or copy the performance data in the area II to the area I in the performance data memory 62. Hereinafter, description will be given with respect to this copy function.

Figure 25:
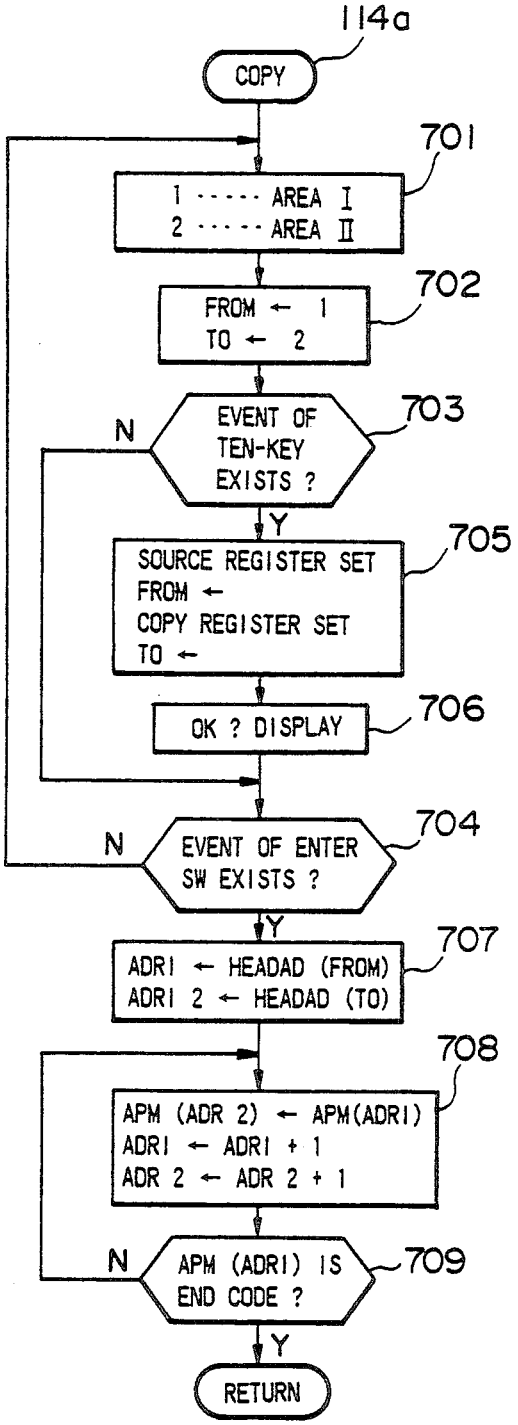

When the player manipulates the mouse **20*d* to move the cursor and thereby select the copy function, the processing proceeds to step 114*a* via steps 103 and 104*a* in FIG. 17. FIG. 25 is a flowchart showing the detailed operations of this routine 114*a***.

In first step 701 of FIG. 25, the display unit **20*c*** displays the following image:

1 . . . AREA I
2 . . . AREA II

This display means that the number "1" designates the area I and number "2" designates the area II. In next step 702, the following image is displayed:

FROM<−1
to <−2

This display means that the performance data in the area I is copied into the area II. Then, in step 703, it is judged whether or not the UP/DOWN key, ten-key in the console panel 20 or the mouse **20*d* is operated. When the judgement result of step 703 is "NO", the processing proceeds to step 704 wherein it is judged whether or not the ENTER switch in the console panel 20 is operated on. If the judgement result of &his step 704 is "NO", the processing returns to step 701, whereby the processes of steps 701 to 704** are repeatedly executed afterwards.

On the other hand, when the player operates the UP/DOWN key, ten-key or mouse **20*d* to thereby newly set the numbers in the foregoing step 702, the judgement result of step 703 turns to "YES". Then, the processing proceeds to step 705 wherein the newly set numbers are respectively written into the source register FROM and copy register TO. In next step 706, the display unit 20*c* displays the characters "OK?". Next, the processing returns to step 701 via step 704. Thereafter, the processes of steps 701 to 704 are repeatedly executed. In order to change the copy source and copy destination, the player operates the ten-key, thus the processes of steps 705 and 706 are executed. On the other hand, when the player accepts the present copy source and copy destination, the player depresses the ENTER key. By depressing the ENTER key, the judgement result of step 704 turns to "YES", so that the processing proceeds to step 707 wherein the head address data HEADAD(FROM) indicated by the data in the source register FROM is set as the address ADR1 and another head address data HEADAD(TO) indicated by the data in the copy register TO is set as the address ADR2. In next step 708, the performance data stored in the storing position APM(ADR1) indicated by the address ADR1 is read out, and then the read performance data is transferred to another storing position APM(ADR2) in the memory 62. Next, the addresses ADR1 and ADR2 are respectively incremented. Then, the processing proceeds to step 709 wherein it is judged whether or not the performance data transferred to the storing position APM(ADR2) designates the end code. When the judgement result of step 708 is "NO", the processing returns to step 708, whereby the performance data are transferred and then the addresses ADR1, ADR2 are incremented again. Thereafter, the processes of steps 708 and 709 are repeatedly executed, so that the copy is made from area I to area II or from area II to area I. Then, when the end code is transferred, the judgement result of step 709** turns to "YES", thus the copy is completed and the processing returns to the main routine.

(C) Modified Examples (1) Due to the delays for the automatic performances I, II, the performance data read from the memory 62 are temporarily stored in the key buffer registers KYB1, KYB2 and then delayed, and such delayed performance data are supplied to the musical tone signal generating circuit 53 in the second embodiment described heretofore. Instead, it is possible to directly delay the reading timings of the performance data in the areas I and II. More specifically, even if the starting operation for the automatic performances I, II is designated, the performance data are not immediately read from the areas I, II. But, after the delay times set in the timer registers TM1, TM2 are passed, the reading of the performance data from the areas I, II are started.

(2) In the second embodiment, the operation of writing the performance data into the memory 62 is executed by actually playing the tune by the keyboard 10. Instead, it is possible to provide the key for designating the pitch of the note and another key for designating the length of the note. In this case, the performance data (i.e., the tone pitch data, note length data) concerning each note of the tune can be inputted by operating the above-mentioned keys.

(3) In the second embodiment, the performance data of the notes are sequentially stored in the memory 62 in accordance with the progress of the tune. However, the present invention is not limited to this embodiment. So, it is possible to adopt the arbitrary storing formats of the performance data. For example, the storing formats as disclosed in Japanese Patent Laid-Open Publication No. 58-2890 can be adopted. Or, it is possible to employ another method in which the timing of performing the note is stored by every kind of note (i.e., tone pitch and note length) used in the tune to be performed.

[III] THIRD EMBODIMENT (A) Configuration of Third Embodiment

The configuration of third embodiment is equivalent to that of first embodiment, hence, description thereof will be omitted.

(B) Operation of Third Embodiment

In the third embodiment, the main routine process, the processes of track switches 26a, 26b are identical to those of the first embodiment (see FIGS. 5 to 7), hence, description thereof will be omitted.

(1) Normal Performance Mode

As similar to the first embodiment, when the normal mode is set in the third embodiment, the speaker 55 generates the musical tones corresponding to the performance played by use of the keyboard 10 and console panel 20.

Figure 26A:
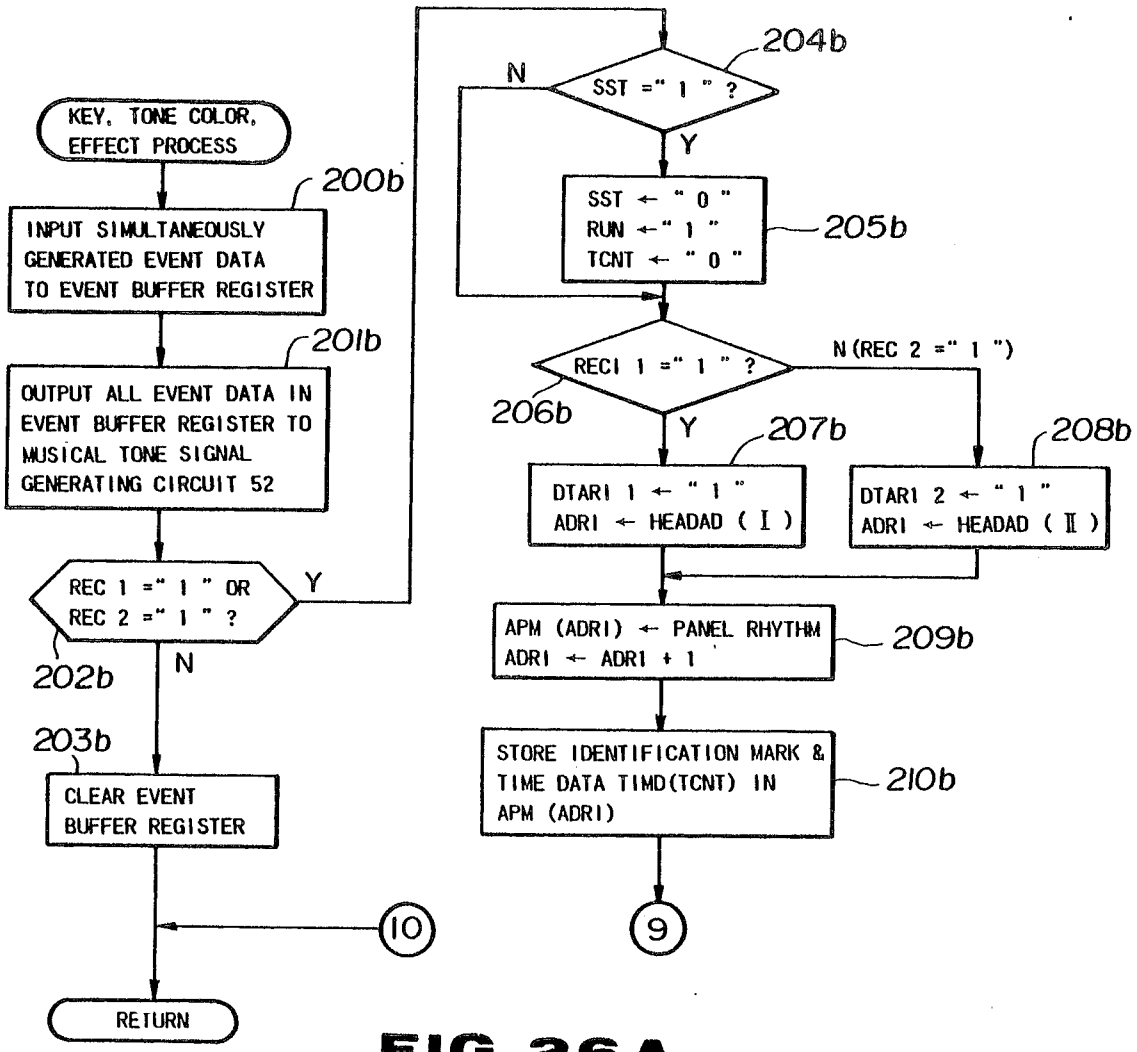
FIGS. 26A to 28B are flowcharts showing processes according to a third embodiment of the present invention.
Figure 26B:
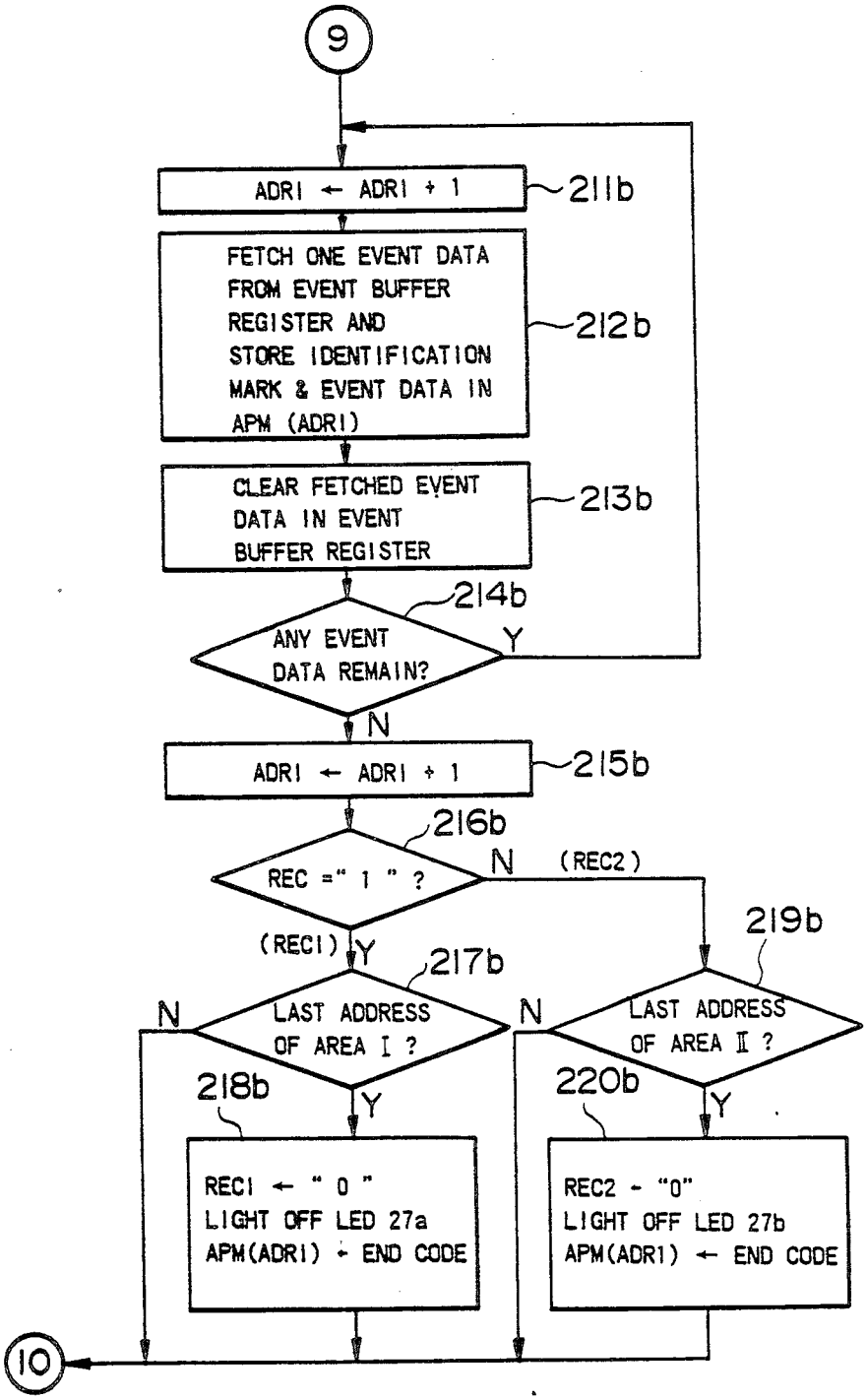

More specifically, when any one of keys in the keyboard 10 is operated, the processing enters into the key, tone color event routine as shown in FIGS. 26A and 26B (corresponding to FIGS. 8A and 8B of the first embodiment). In first step 200b, the buffer register 63 inputs the event data, i.e., the key-depression data consisting of the key code KC, key touch data KTD and identification mark of the depressed key. This event data is supplied to the musical tone signal generating circuit 52 in step 201b, thus the musical tone of the depressed key is generated. In this case, the judgement result of next step 202b is "NO", so that the buffer register 63 is cleared in step 203b. Then, the processing returns to step 102 of FIG. 5.

On the other hand, when the depressed key is released, the buffer register 63 inputs the key-release data consisting of the identification mark and key code KC of the released key. This key-release data is supplied to the musical tone signal generating circuit 52, thus the generation of the musical tone of the released key is terminated.

Next, when the tone color selecting switch 23 is operated, the data thereof is written into the buffer register 63 and then supplied to the circuit 52. Thus, the tone color corresponding to the operated tone color selecting switch is set in the musical tone signal generating circuit 52. Similarly, when the master volume 24 is operated, the data indicative of the operation of the master volume 24 is supplied to the circuit 52, thus the tone volume of the musical tone to be generated is varied.

Figure 27:
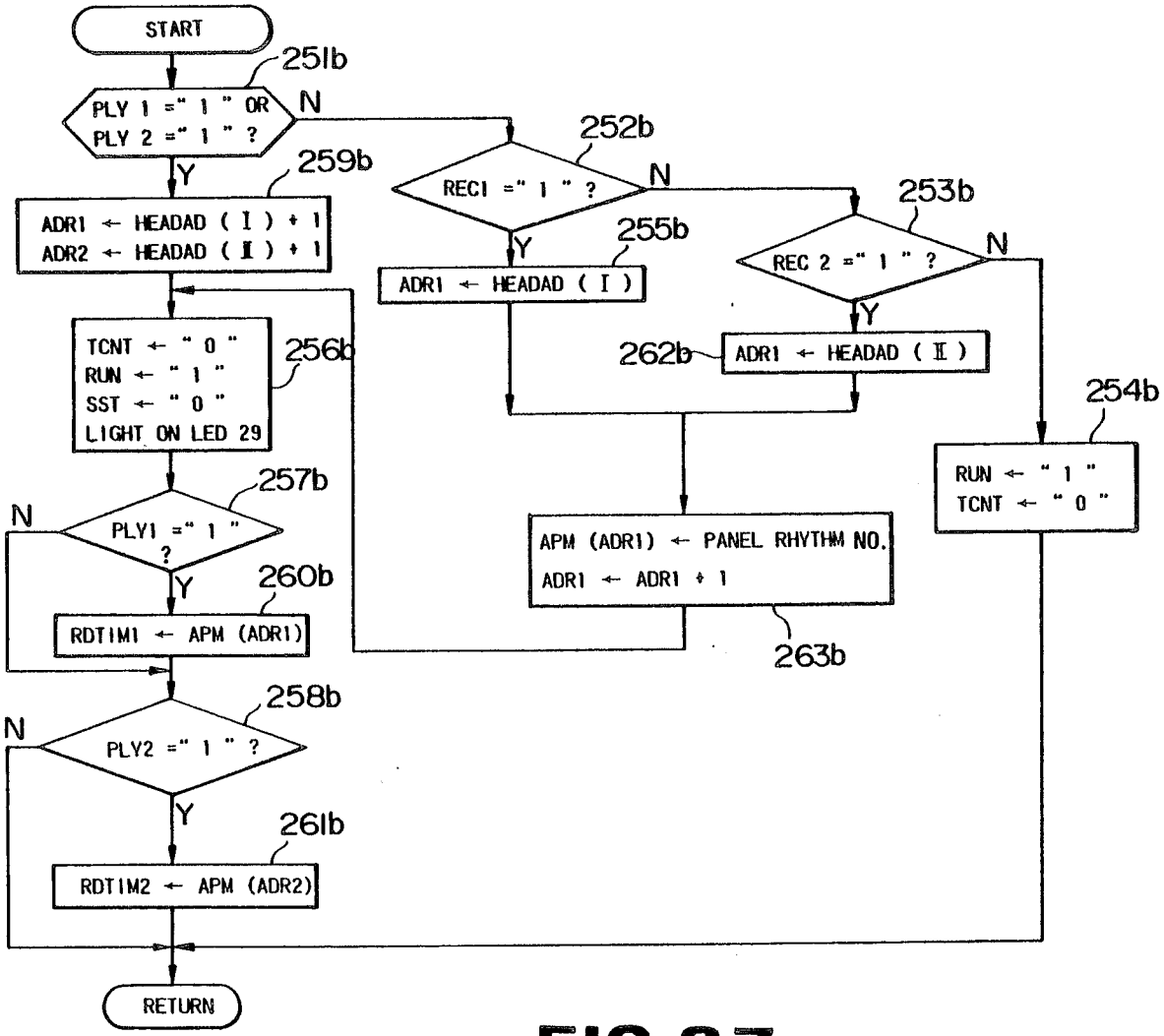

Next, when the start switch 28 is depressed in order to generate the rhythm tone, the processing enters into the start process routine as shown in FIG. 27 (corresponding to FIG. 9). In this case, the processing passes through steps 251, 252 and 253 to thereby proceed to step 254 wherein "1" is set to the rhythm run flag RUN and the tempo count data TCNT is cleared. Then, the processing returns to step 102 of FIG. 5.

After "1" is set to the rhythm run flag RUN in the foregoing step 254 when the start switch 28 is depressed in the normal performance mode, the rhythm tone is generated based on the tempo clock from the tempo oscillator 40.

Figure 28A:
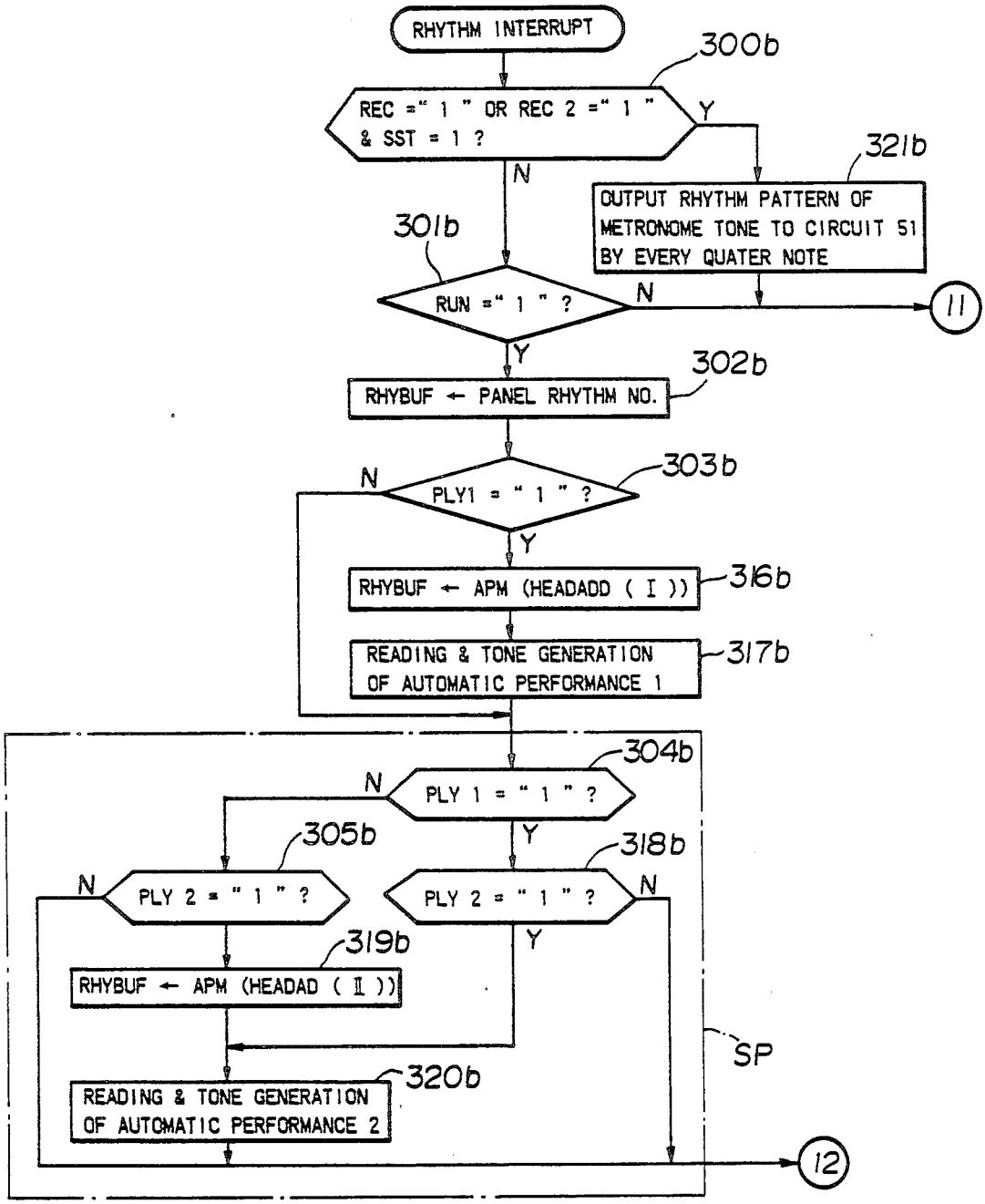
Figure 28B:
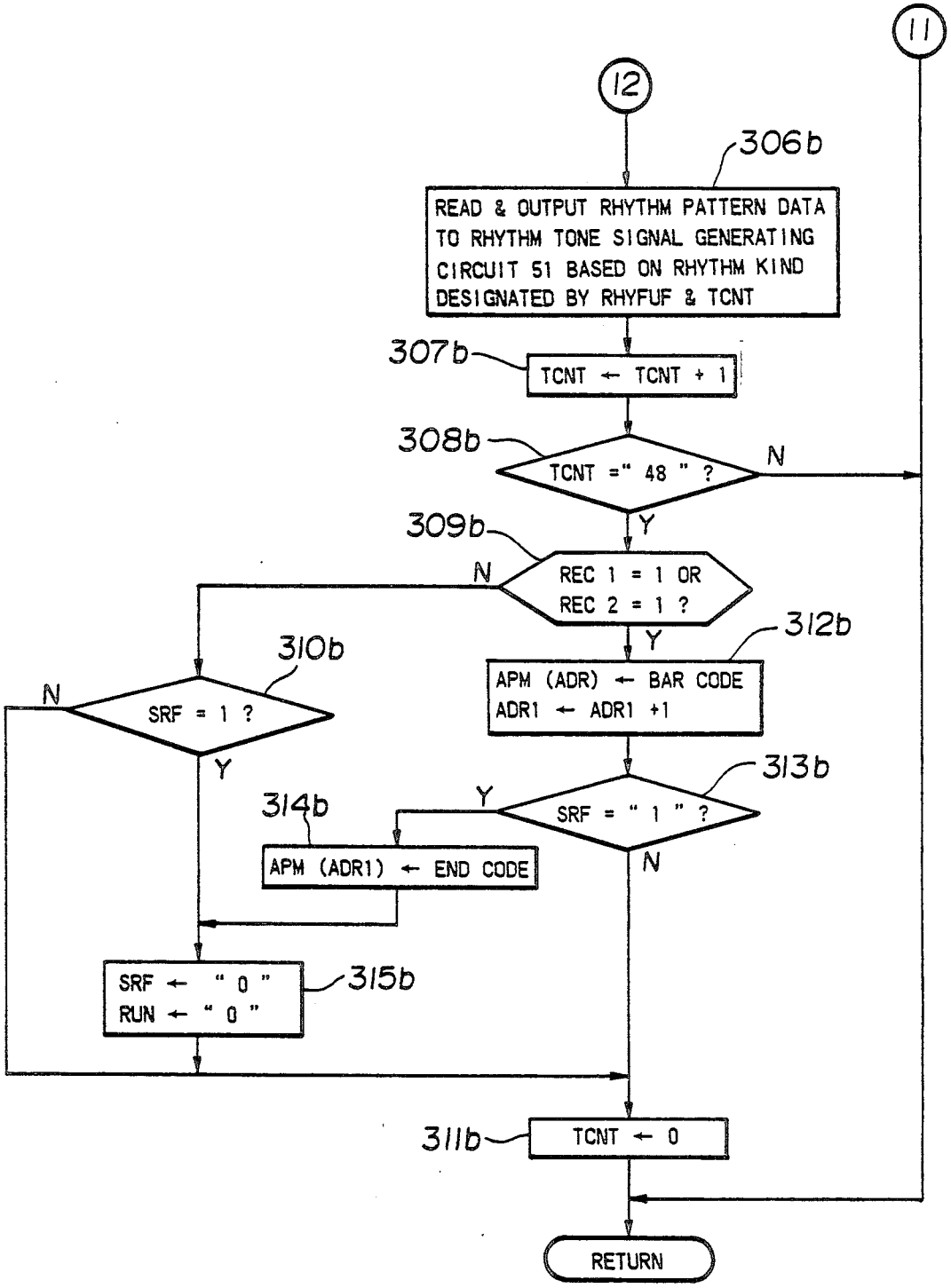

More specifically, this tempo clock interrupts the CPU 72, so that the processing enters into the rhythm interrupt process routine as shown in FIGS. 28A and 28B (corresponding to FIGS. 10A and 10B). In this case, the judgement result of step 300b is "NO" so that the processing proceeds to step 301b wherein it is judged whether or not the rhythm run flag is at "1". If the judgement result of step 301b is "NO", the processing returns to the main routine of FIG. 5. When this judgement result is "YES", the processing proceeds to step 302b wherein the CPU 72 scans the switching circuit 20a, thus the number of the on-switch within the rhythm selecting switches 22 is inputted into the rhythm data buffer RHYBUF as the selected rhythm number.

In this case, since the judgement results of steps 303b, 304b and 305b are "NO", the processing proceeds to step 306b (shown in FIG. 28B). In this step 306b, the rhythm pattern data is read from the memory 61, wherein this rhythm pattern data is based on the tempo count data TCNT of the rhythm kind indicated by the rhythm data RHYBUF. Then, such read rhythm pattern data drives the percussive musical tone signal generating circuit within the circuit 51, whereby the desirable rhythm tone is to be generated. Herein, this rhythm data buffer RHYBUF stores the rhythm number designated by the rhythm selecting switch 22. Therefore, in the normal performance mode, the rhythm tone is generated in accordance with the designation of the rhythm selecting switch 22 during the performance.

In next step 307b, the tempo count data TCNT is incremented. Since this tempo count data does not reach the bar end value "48", the judgement result of step 308b turns to "NO, so that the processing returns to the main routine.

Afterwards, every time the tempo clock is generated, the rhythm tone is generated and then TCNT is incremented in the foregoing steps 306b and 307b. When TCNT reaches "48", the processing proceeds to step 309b via step 308b. Since the record flag REC1 or REC2 is not at "1" and the stop reserve flag SRF is not at "1", the processing proceeds to step 311b via steps 309b and 310b. In step 311b, the tempo count data TCNT is cleared, and then the processing returns to the main routine.

The above is the description of the process of generating the rhythm tone. Next, in order to terminate the rhythm tone generation in the normal performance mode, the stop/continue switch 30 is depressed. The stop/continue process routine of the third embodiment is the same of the first embodiment (see FIG. 11), hence, description thereof will be omitted.

(2) Data Writing Mode

Due to the same operation in the data writing mode of the first embodiment, the mode data M1 is set at "2", and several flags are set in a manner that PLY1 is at "0", REC1 is at "1", SST is at "1". In this case, the metronome tone informs the player of the tempo corresponding to the tempo clock of the tempo oscillator 40. Then, the processing of the CPU 72 is interrupted and it proceeds to the rhythm interrupt process as shown in FIG. 28A and 28B. In this case, the judgement result of step 300b turns to "YES" so that the processing proceeds to step 321b wherein the rhythm pattern data of the metronome tone is read from the memory 61 and then supplied to the rhythm tone signal generating circuit 51, whereby the metronome tone is generated by every quarter note timing.

Next, when the key is depressed, the processing enters into the key, tone color event routine as shown in FIGS. 26A and 26B. Due to the processes of steps 200b and 201b, the musical tone of the depressed key is generated. Since the judgement results of steps 202 and 204 are both "YES", the processing proceeds to step 205b wherein the synchro-start flat SST is set at "0", the rhythm run flag RUN is set at "1" and the tempo count data TCNT is cleared. In this case, the metronome tone generation is terminated after SST is set at "0", while the rhythm tone generation is terminated after RUN is set at "1". Then, the processing proceeds to step 207b via step 206b wherein the record check flag DTARI1 is set at "1" and the head address data HEADAD(I) is set as the address data ADR1. Thereafter, the processing proceeds to step 209b. Meanwhile, when the record flag REC2 is at "1" (i.e., the writing operation of the area II is made), the processing proceeds to step 208b from step 206b, wherein the record check flag DTARI2 is set at "1" and the head address data HEADAD(II) is set as the address data ADR1. In next step 209b, the CPU 72 detects the rhythm number indicative of the number of the rhythm selecting switch which is on, and this rhythm number is stored at the storing position indicated by ADR1 in the memory 62 as the data APM-(ADR1). Then, the address data ADR1 is incremented.

Next, in step 210b, the timing data consisting of the identification mark and time data TIMD is written at the storing position indicated by ADR1 in the memory 62 as the data APM(ADR1). As this time data TIMD, the tempo count data TCNT is used. Therefore, the present time data TIMD is at "1" (see step 205b). In next step 211b in FIG. 26B, the address data ADR1 is incremented. In step 212b, the first event data read from the buffer register 63 is added with the identification mark and then written into the memory 62 as the data APM-(ADR1). In step 213b, the above-mentioned first event data is cleared in the buffer register 63. Then, when the buffer register 63 stores any event data so that the judgement result of step 214b is "YES", the CPU 72 executes the foregoing processes of steps 211b to 213b again. On the other hand, when the judgement result of step 214b is "NO", the address data ADR1 is incremented in step 215b. If the record flat REC1 is at "1" so that the judgement result of step 216b is "YES", the processing proceeds to step 217b wherein it is judged whether or not the address data ADR1 designates the last address of the area I. Thereafter, the processing returns to step 102 of the main routine when the judgement result of step 217b is "NO", while the processing proceeds to step 218b when it is "YES". In step 218b, the record flag REC1 is reset, the LED 27a is lighted off and the end code is written into the memory 62 as the data APM(ADR1). Afterwards, the processing returns to the main routine. On the other hand, when the record flag REC2 is at "1" so that the judgement result of step 216b is "NO", the process of step 219b (corresponding to step 217b) is executed. Thereafter, when the judgement result of step 219b is "YES", the process of step 220b (corresponding to step 218b) is executed.

As described above, when the key of the keyboard 10 is depressed in the state where the mode data M1 is at "2" and M2 is at "0", the rhythm run flag RUN is set at "1" (in step 205b), so that the rhythm tone generation is started. And, the event data concerning the depressed key is written into the area I. Afterwards, every time the key is depressed or the switch of the console panel 20 is operated, the foregoing processes of steps 210b to 214b are executed so that the performance data is written into the area I.

At the bar end timing, the judgement result of step 308b (see FIG. 28B) turns to "YES" so that the processing proceeds to step 312b via step 309b, wherein the bar code is written into the memory 62 as the data APM-(ADR1) and then ADR1 is incremented.

Next, when the address data ADR1 reaches the last address of area I, the process of step 218b is executed so that the data writing mode is completed. In order to complete the data writing mode before ADR1 reaches the last address of area I, the stop/continue switch 30 is depressed.

By depressing this stop/continue switch 30, the processing enters into the foregoing stop/continue process routine of the first embodiment.

In this stop/continue process routine, the stop reserve flag SRF is set at "1", thus the judgement result of step 313b in FIG. 28B turns to "YES" at the next bar end timing. In next step 314b, the end code is written into the memory 62 as the data APM(ADR1). In step 315b, SRF and RUN are both reset and the LED 29 is lighted off. Then, the processing proceeds to step 311b wherein TCNT is cleared. Thereafter, the processing returns to the main routine.

The above is the description of the mode of writing the performance mode in the third embodiment. In this third mode, the data writing and rhythm tone generation is started by depressing the key of the keyboard 10. However, it is possible to start the data writing and rhythm tone generation by depressing the start switch 28.

More specifically, when the start switch 28 is depressed after M1 is set at "2" (M2 is set at "0"), the processing proceeds to step 255b via steps 251b and 252b in FIG. 27, wherein HEADAD(I) is set as ADR1. In next step 263b, the CPU 72 detects the rhythm number of the rhythm selecting switch 22 which is turned on, and this detected rhythm number is written at the storing position indicated by ADR1 in the memory 62 as APM(ADR1). Then, ADR1 is incremented. In next step 256b, TCNT is cleared, RUN is set, SST is reset and LED 29 is lighted on. Thereafter, the processing returns to the main routine via steps 257b and 258b.

As described above, when the start switch 28 is depressed after M1 is set at "2", the address data ADR1 is set to the head address of the area I and the rhythm run flag RUN is set at "1" so that the rhythm tone generation is started. At the same time, the rhythm number indicative of the desirable rhythm kind is stored at the head storing position HEADAD(I) of the area I. Thereafter, by operating the key of the keyboard 10 to play the performance, its performance data are sequentially written into the area I.

Similar to the area I, the data writing operation of the area II is executed.

(3) Automatic Performance Mode

Next, description will be given with respect to the automatic performance mode of the third embodiment in the following three cases.

(a) Automatic Performance Based on Performance Data In Area I

When the start switch 28 is depressed in this case, the processing proceeds to step 259b via step 251b, wherein the head address data HEADAD(I)+1 is set as the address data ADR1, while HEADAD(II)+1 is set as ADR2. Then, after executing the process of step 256b, the processing proceeds to step 260b via step 257b, wherein the data APM(ADR1) indicated by ADR1 is read from the memory 62 and then set as the read timing data RDTIM1. Thereafter, the processing returns to the main routine via step 258b.

As described above, when the automatic mode of the area I is set and then the start switch 28 is depressed, PLY1 is set and then RUN is set. After that, the automatic performance tone and rhythm tone are generated based on the tempo clock outputted from the tempo oscillator 40.

This tempo clock interrupts the CPU 72, thus the rhythm interrupt process shown in FIGS. 28A and 28B are started. In this case, the processing proceeds to step 302*b* via steps 300*b* and 301*b*, wherein the rhythm number of the rhythm selecting switch which is turned on is inputted into the rhythm data buffer RHYBUF. Next, the processing proceeds step 316*b* via step 303*b*, wherein the rhythm number stored in the head storing position HEADAD(I) in the area I is read out and then written into RHYBUF. Due to the process of step 316*b*, the rhythm data RHYBUF is renewed (or rewritten) by the data stored at the head storing position of the area I.

Next, the processing proceeds to step 317*b* indicative of the routine RI (see FIG. 13A) for reading the automatic performance data I, whose description will be omitted.

After executing the routine RI, the processing proceeds to step 304*b* of FIG. 28A. Since the judgement result of step 304*b* is "YES" but the judgement result of next step 318*b* is "NO", the processing proceeds to step 306*b* shown in FIG. 28B.

In step 306*b*, the desirable rhythm pattern data is read from the memory 61, wherein this data indicated by the tempo count data TCNT designates the rhythm kind which is indicated by the rhythm data RHYBUF. This data is supplied to the rhythm tone signal generating circuit 51, so that the desirable rhythm tone is generated. In this case, the rhythm number stored at the head storing position of the area I is set in the rhythm data buffer RHYBUF. Therefore, in the automatic performance based on the performance data of area I, the rhythm tone is generated in accordance with the rhythm kind which is used when writing the performance data into the area I.

In next step 307*b*, TCNT is incremented. In step 308*b*, it is judged whether or not the present timing is the bar end timing. If the judgement result of step 308*b* is "NO", the CPU 72 completes the rhythm interrupt process routine and the processing returns to the main routine.

At the bar end timing, the processing proceeds to step 310*b* via steps 308*b* and 309*b*, wherein it is judged whether or not SRF is at "1". Then, the processing proceeds to step 315*b* when the judgement result of step 310*b* is "YES", while the processing proceeds to step 311*b* when it is "NO". In step 311*b*, TCNT is cleared, and then the processing returns to the main routine.

In order to stop the automatic performance in the middle of the automatic performance, the stop/continue switch 30 is depressed so that the processing enters into the stop/continue process routine, which is identical to that of the first embodiment. In step 405 of the stop/-continue process routine (see FIG. 11), SRF is set at "1". Thus, at the next bar end timing, the judgement result of step 310*b* turns to "YES" so that the processing proceeds to step 315*b* wherein SRF and RUN are both reset. In addition, the LED 29 is lighted off. When RUN is reset, the processes of steps 317*b* and 303*b* (in FIG. 28A) are prevented from being executed. Thus, the rhythm tone generation is terminated.

(b) Automatic Performance Based on Performance Data In Area II

When the start switch 28 is depressed, the processing proceeds to step 251*b* of FIG. 27. In this case, the processing proceeds to next step 259*b* via this step 241*b*, wherein HEADAD(I)+1 is set as ADR1 and HEADAD(II)+1 is set as ADR2 respectively. After executing the process of step 256*b*, the processing proceeds to step 261*b* via steps 257*b* and 258*b*, wherein the data APM(ADR2) indicated by ADR2 is read out and then set as the read timing data RDTIM2.

As described above, after PLY2 is set and then RUN is set, the automatic performance tone and rhythm tone are generated based on the tempo clock outputted from the tempo oscillator 40.

More specifically, this tempo clock interrupts the CPU 72, so that the processing enters into the rhythm interrupt process routine as shown in FIGS. 28A and 28B. In this case, the processing proceeds to step 319*b* via steps 300*b*, 301*b*, 302*b*, 303*b*, 304*b* and 305*b*, wherein the rhythm number stored at the head storing position HEADAD(II) of the area II is read out and then stored in the rhythm data buffer RHYBYF.

Next, the processing proceeds to step 320*b* wherein the CPU 72 executes the routine RII for the automatic performance data II (see FIG. 13B).

After executing this routing RII, the processing proceeds to step 306*b* of FIG. 28B wherein the rhythm number stored in RHYBUF and the rhythm pattern data indicated by TCNT are read from the memory 61. These data are supplied to the rhythm tone signal generating circuit 51, whereby the rhythm tone is generated. In this case, the rhythm number stored at the head storing position of the area II is set in RHYBUF. Therefore, the generated rhythm tone corresponds to the rhythm kind which is used when writing the performance data into the area II.

After this step 306*b*, the CPU 72 executes the processes of steps 307*b* etc. which are similar to those in the case of the automatic performance based on the performance data of area I.

(c) Automatic Performance Based on Performance Data In Areas I & II

When the start switch 28 is depressed in this case, the processing proceeds to step 260*b* via steps 251*b*, 259*b*, 256*b* and 257*b*, wherein the data APM(ADR1) indicated by ADR1 is read from the memory 62 and then set as the read timing data RDTIM1. Then, the processing proceeds to step 261*b* via step 258*b*, wherein the data APM(ADR2) indicated by HEADAD(II)+1 is read from the memory 62 and then set as the read timing data RDTIM2.

Thereafter, the automatic performance tone and rhythm tone are generated based on the tempo clock outputted from the tempo oscillator 40.

Due to this tempo clock, the rhythm interrupt process routine as show in FIGS. 28A and 28B is executed. In this case, the processing proceeds to step 316*b* via steps 300*b* to 303*b*, wherein the rhythm number is read from the head storing position HEADAD(I) of the area I and then stored in RHYBUF.

In next step 317*b*, the automatic performance is played based on the performance data of the area I by executing the routing RI of FIG. 13A.

Then, the processing proceeds to step 320*b* via steps 304*b* and 318*b*, wherein another automatic performance is played based on the performance data of the area II by executing the routine RII of FIG. 13B.

Next, the processing proceeds to step 306*b* of FIG. 28B wherein the rhythm number stored in RHYBUF and the rhythm pattern data indicated by TCNT are read from the memory 61. These data are supplied to the rhythm tone signal generating circuit 51, whereby the rhythm tone is generated. In this case, the rhythm number stored at the head storing position of the area I is set in RHYBUF. Therefore, the generated rhythm tone has the rhythm kind which is used when the performance data is written into the area I.

Afterwards, the processes of steps 307*b* etc. are executed as similar to the foregoing case of the automatic performance based on the performance data of one of the areas I and II.

(C) Modified Examples of Third Embodiment (1) The third embodiment described heretofore provides two areas I and II. However, it is possible to modify the third embodiment to use three or more storing areas. In this case, after the subroutine SP consisting of steps 304*b*, 305*b*, 318*b*, 319*b* and 320*b* in FIG. 28A, the similar subroutine is additionally provided. In this added subrouting, some words must be replaced such as PLY2-PLY3, HEADAD(II)-HEADAD(III), automatic performance 2-automatic performance 3. In addition, in the foregoing step 309*b* of FIG. 28B, the condition "PLY3=1" is added. In such way, three storing areas can be provided. Similarly, it is possible to modify the third embodiment to provide four, five or more storing areas.

(2) The third embodiment designates the rhythm pattern kind in the case where the automatic performance is made based on plural performance data. However, it is possible to modify the third embodiment to designate the bass pattern kind. Or, it is also possible to designate both of the rhythm pattern kind and bass pattern kind.

Above is the detailed description of the preferred embodiments of the present invention. This invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. An automatic performance apparatus for playing an automatic performance based on performance data, comprising:

(a) memory means having a plurality of storing areas each capable of storing said performance data;

(b) writing means for writing said performance data into said storing areas;

(c) designating means, provided for each storing area, for designating a record mode in which said performance data is written in said memory means by said writing means;

(d) detecting means for detecting whether or not any one of said storing areas is in the record mode; and (e) control means, responsive to a detection by said detecting means that a storing area is in the record mode, for prohibiting other storing areas from being set to the record mode.

2. An automatic performance apparatus according to claim 1 wherein said control means skips said record mode and then automatically sets another mode for said storing area when said storing area detected by said detecting means and any one of other storing areas are both in said record mode.

3. An automatic performance apparatus for playing an automatic performance based on performance data, comprising:

(a) a memory means for storing said performance data;

(b) designating means for designating said automatic performance;

(c) detecting means for detecting whether or not said performance data is stored in said memory; and (d) control means for prohibiting said automatic performance from being designated by said designating means when said detecting means detects that said performance data is not stored in said memory.

4. An automatic performance apparatus for playing an automatic performance based on performance data, comprising:

(a) a memory means for storing performance data;

(b) generating means for generating an automatic performance signal corresponding to said performance data;

(c) detecting means for detecting an automatic performance start or stop signal; and (d) control means for controlling said generating means to stop generating said automatic performance signal at a start timing of a next bar when said detecting means detects said stop signal during said automatic performance, and for controlling said generating means to re-start generating said automatic performance signal at said start timing of the next bar to a currently played bar when said detecting means detects said start signal.

5. An automatic performance apparatus for playing an automatic performance based on performance data, comprising:

(a) a memory for storing said performance data;

(b) writing means for writing said performance data into said memory;

(c) detecting means for detecting a signal for said writing means to stop writing said performance data; and (d) control means for controlling said writing means to stop writing said performance data at a start timing of a next bar to a currently played bar when said detecting means detects said signal for said writing means to stop writing said performance data.

6. An automatic performance apparatus comprising:

(a) a plurality of memories each storing performance data, wherein one of said memories stores first performance data representing a first musical tone, while another of said memories stores second performance data representing a second musical tone;

(b) reading means for reading said performance data from said memories;

(c) musical tone signal generating means for generating a musical tone signal based on said performance data read from said memories;

(d) delay time setting means for setting a delay time between a first musical tone signal based on said first performance data stored in one of said memories and a second musical tone signal based on said second performance data stored in another of said memories; and (e) delay means for delaying generation of the first musical tone signal behind that of a second musical tone signal by the delay time set by said delay time setting means.

7. An automatic performance apparatus for playing an automatic performance based on performance data, comprising:

(a) a performance data memory having a plurality of storing areas each capable of storing said performance data, wherein one or more of said storing areas have rhythm data corresponding to a specified rhythm tone assigned thereto;

(b) writing means for writing said performance data into desirable storing areas within said performance data memory;

(b) an accompaniment data memory having a plurality of storing areas each storing accompaniment data corresponding to several kinds of accompaniments;

(c) generating means for generating an accompaniment musical tone signal accompanied with said musical tone signal based on said performance data, said accompaniment musical tone signal being generated based on said accompaniment data supplied to said generating means; and (d) accompaniment data designating means for designating single accompaniment data corresponding to performance data read from one storing area within said performance data memory when a musical tone signal is to be generated based on said performance data, said accompaniment data designating means designating any one of plural accompaniment data corresponding to plural performance data read from plural storing areas within said performance data memory when plural musical tones are to be generated based on said plural performance data.

8. An automatic performance apparatus comprising:

(a) a plurality of memories each storing performance data, wherein one of said memories stores first performance data representing a first musical tone, while another of said memories stores second performance data representing a second musical tone;

(b) reading means for reading said performance data from said memories;

(c) musical tone signal generating means for generating a musical tone signal based on said performance data read from said memories; and (d) delay means for delaying generation of a first musical tone signal based on said first performance data stored in one of said memories behind that of a second musical tone signal based on said second performance data stored in another of said memories by a predetermined delay time, said delay means comprising:

(i) first delay means for delaying a first generation timing of said first musical tone signal by a first delay time; and (ii) second delay means for delaying a second generation timing of said second musical tone signal by a second delay time which can be set independently of said first delay time.

* * * * *